US006575753B2

(12) United States Patent
Rosa et al.

(10) Patent No.: US 6,575,753 B2
(45) Date of Patent: Jun. 10, 2003

(54) FIREARM LASER TRAINING SYSTEM AND METHOD EMPLOYING AN ACTUABLE TARGET ASSEMBLY

(75) Inventors: Stephen P. Rosa, Ellicott City, MD (US); Motti Shechter, Potomac, MD (US); John Clark, Finksburg, MD (US); Tansel Kendir, Sykesville, MD (US)

(73) Assignee: Beamhit, LLC, Columbia, MD (US)

( * ) Notice: Subject to any disclaimer, the term of this patent is extended or adjusted under 35 U.S.C. 154(b) by 181 days.

(21) Appl. No.: 09/862,187

(22) Filed: May 21, 2001

(65) Prior Publication Data

US 2003/0091960 A1 May 15, 2003

Related U.S. Application Data

(60) Provisional application No. 60/205,811, filed on May 19, 2000.

(51) Int. Cl.[7] ..... F41A 33/00
(52) U.S. Cl. ..... 434/16; 434/19; 434/11
(58) Field of Search ..... 434/11, 16, 17, 434/18, 19, 21, 23, 24

(56) References Cited

U.S. PATENT DOCUMENTS

| | | | |
|---|---|---|---|
| 2,023,497 | A | 12/1935 | Trammell |
| 2,934,634 | A | 4/1960 | Hellberg |
| 3,452,453 | A | 7/1969 | Ohlund |
| 3,510,965 | A | 5/1970 | Rhea |
| 3,526,972 | A | 9/1970 | Sumpf |
| 3,590,225 | A | 6/1971 | Murphy |
| 3,633,285 | A | 1/1972 | Sensney |
| 3,782,832 | A | 1/1974 | Hacskaylo |
| 3,792,535 | A | 2/1974 | Marshall et al. |
| 3,938,262 | A | 2/1976 | Dye et al. |
| 3,995,376 | A | 12/1976 | Kimble et al. |

(List continued on next page.)

FOREIGN PATENT DOCUMENTS

| | | | |
|---|---|---|---|
| CH | 204889 | 5/1939 | |
| DE | 40 05 940 A1 | 8/1981 | |
| DE | 3537323 | 4/1987 | |
| DE | 3631081 A1 | 3/1988 | |
| EP | 0127288 | 5/1984 | |
| EP | 0 285-586 A2 | 10/1988 | |
| EP | 0 401 731 | 6/1990 | |
| EP | 0 806 621 A1 | 11/1997 | |
| GB | 2254403 | 10/1992 | |
| GB | 2284 253 A | 5/1995 | |
| JP | 2-101398 A | 4/1990 | |
| SU | 1817825 A3 | 5/1993 | |
| WO | WO 91/09266 | 6/1991 | |
| WO | WO 92/08093 | 5/1992 | |
| WO | WO 94/03770 | 2/1994 | |
| WO | WO 94/15165 | 7/1994 | |
| WO | WO 98/49514 | 11/1998 | |
| WO | WO 99/10700 | 3/1999 | |
| WO | WO 01/90675 A2 * | 11/2001 | ..... F41A/33/00 |

*Primary Examiner*—Hieu T. Vo

(57) ABSTRACT

A firearm laser training system of the present invention includes a laser transmitter assembly, one or more actuable target assemblies each having a target, an interface unit and a computer system. The target assemblies raise and lower targets in accordance with control signals from the computer system. The interface unit is connected to the target assemblies and the computer system and transfers signals therebetween. In an alternative embodiment, the computer system is connected to a control unit that transmits control signals received from the computer system to the target assemblies via a distribution unit. The targets are raised by corresponding target assemblies at prescribed times for a specific time interval to indicate intended targets for the user, and are lowered in response to the beam impacting the raised targets within that interval (e.g., indicating a hit) or upon expiration of the interval without a beam impact (e.g., indicating a miss).

39 Claims, 17 Drawing Sheets

U.S. PATENT DOCUMENTS 3,996,674 A 12/1976 Pardes et al.
4,048,489 A 9/1977 Giannetti
4,102,059 A 7/1978 Kimble et al.
4,164,081 A 8/1979 Berke
4,177,580 A 12/1979 Marshall et al.
4,195,422 A 4/1980 Budmiger
4,232,867 A 11/1980 Tate, Sr.
4,269,415 A 5/1981 Thorne-Booth
4,281,993 A 8/1981 Shaw
4,290,757 A 9/1981 Marshall et al.
4,313,272 A 2/1982 Matthews
4,313,273 A 2/1982 Matthews et al.
4,336,018 A 6/1982 Marshall et al.
4,340,370 A 7/1982 Marshall et al.
4,352,665 A 10/1982 Kimble et al.
4,367,516 A 1/1983 Jacob
4,452,458 A 6/1984 Timander et al.
4,553,943 A 11/1985 Ahola et al.
4,561,849 A 12/1985 Eichweber
4,583,950 A 4/1986 Schroeder
4,592,554 A 6/1986 Gilbertson
4,619,616 A 10/1986 Clarke
4,640,514 A 2/1987 Myllyla et al.
4,657,511 A 4/1987 Allard et al.
4,662,845 A 5/1987 Gallagher et al.
4,678,437 A 7/1987 Scott et al.
4,680,012 A 7/1987 Morley et al.
4,695,256 A 9/1987 Eichweber
4,737,106 A 4/1988 Laciny
4,761,907 A 8/1988 De Bernardini
4,786,058 A 11/1988 Baughman
4,788,441 A 11/1988 Laskowski
4,804,325 A 2/1989 Willits et al.
4,811,955 A 3/1989 De Bernardini
4,830,617 A 5/1989 Hancox et al.
4,922,401 A 5/1990 Lipman
4,934,937 A 6/1990 Judd
4,947,859 A 8/1990 Brewer et al.
4,948,371 A 8/1990 Hall
4,983,123 A 1/1991 Scott et al.
4,988,111 A 1/1991 Gerlizt et al.
5,004,423 A 4/1991 Bertrams
5,031,349 A * 7/1991 Vogel ..... 42/115
5,064,988 A 11/1991 E'nama et al.
5,092,071 A 3/1992 Moore
5,095,433 A 3/1992 Botarelli et al.
5,119,576 A 6/1992 Erning
5,140,893 A 8/1992 Leiter
5,153,375 A 10/1992 Eguizabal
5,179,235 A 1/1993 Toole
5,194,006 A 3/1993 Zaenglein, Jr.
5,194,007 A 3/1993 Marshall et al.
5,213,503 A 5/1993 Marshall et al.
5,215,465 A 6/1993 Marshall et al.
5,237,773 A 8/1993 Claridge
5,281,142 A 1/1994 Zaenglein, Jr.
5,328,190 A 7/1994 Dart et al.
5,344,320 A 9/1994 Inbar et al.
5,365,669 A 11/1994 Rustick et al.
5,366,229 A 11/1994 Suzuki
5,413,357 A 5/1995 Schulze et al.
5,433,134 A 7/1995 Leiter
5,474,452 A 12/1995 Campagnuolo
5,488,795 A 2/1996 Sweat
5,585,589 A 12/1996 Leiter
5,591,032 A 1/1997 Powell et al.
5,605,461 A 2/1997 Seeton
5,641,288 A 6/1997 Zaenglein, Jr.
5,672,108 A 9/1997 Lam et al.
5,685,636 A 11/1997 German
5,716,216 A 2/1998 O'Loughlin et al.
5,740,626 A 4/1998 Schuetz et al.
5,788,500 A 8/1998 Gerber
5,842,300 A 12/1998 Cheshelski et al.
5,947,738 A 9/1999 Muehle et al.
2002/0009694 A1 * 1/2002 Rosa ..... 434/16
2002/0012898 A1 * 1/2002 Shechter et al. ..... 434/21
2002/0051953 A1 * 5/2002 Clark et al. ..... 434/16
2002/0197584 A1 * 12/2002 Kendir et al. ..... 434/11

* cited by examiner

RAPID LASER MARKSMANSHIP TRAINING SYSTEM
RECORD FIRE SCORE REPORT

SHOOTER

Name (L,F,M): SSN:

Grade : Unit : Roster No :

INSTRUCTOR

Name (L,F,M):

SCENARIO & SCORE

| Seq. | Time | 1 | 2 | 3 | 4 | 5 | 6 | 7 |
|---|---|---|---|---|---|---|---|---|
| 1 | 3 | X | | | | | | |
| 2 | 8 | | | | | X | | |
| 3 | 4 | | | X | | | | |
| 4 | 3 | | | | X | | | |
| 5 | 8 | | | | | | | X |
| 6 | 7 | | | | | | X | |
| 7 | 3 | | X | | | | | |
| 8 | 8 | | | | | X | | |
| 9 | 5 | | | | X | | | |
| 10 | 7 | | | | | | X | |
| 11 | 8 | | | X | | X | | |
| 12 | 10 | | | | X | | | X |
| 13 | 9 | | | X | | | X | |
| 14 | 6 | | | | | X | | |
| 15 | 5 | | | | X | | | |
| 16 | 6 | X | | X | | | | |
| 17 | 2 | | | | | | | |
| 18 | 5 | | | X | | | | |
| 19 | 8 | | | | | | X | |
| 20 | 6 | | | | X | | | |
| 21 | 8 | | X | | | X | | |
| 22 | 12 | | | | X | X | | |
| 23 | 8 | X | | | X | | | |
| 24 | 6 | | | X | | | | |
| 25 | 8 | | | | X | | | |
| 26 | 9 | | | | | | | X |
| 27 | 10 | | | X | | X | | |
| 28 | 12 | | | | X | | X | |
| 29 | 8 | | | X | X | | | |
| 30 | 6 | | | X | | X | | |

TARGETS

1 : F-Type Silhouette Range: 50 m.
2 : F-Type Silhouette Range: 50 m.
3 : E-Type Silhouette Range: 100 m.
4 : E-Type Silhouette Range: 150 m.
5 : E-Type Silhouette Range: 200 m.
6 : E-Type Silhouette Range: 250 m.
7 : E-Type Silhouette Range: 300 m.

QUALIFICATION SETTINGS

EXPERT : From 36 To 40
SHARPSHOOTER : From 30 To 35
MARKSMAN : From 23 To 29
UNQUALIFIED : From 0 To 22

STARTING POSITION

SUPPORTED :

LEGEND

: Position Change in Unsupported — Hit — No Fire
: Position Change in Supported — Miss — Other

INSTRUCTOR REMARKS

Supported Hits : 0 Unsupported Hits : 0 Total Hits : 0
Supported Misses : 0 Unsupported Misses : 0 Total Misses : 0
Supported No Fire: 0 Unsupported No Fire: Total No Fire: 0

QUALIFICATION

EXPERT

FIG.13

FIREARM LASER TRAINING SYSTEM AND METHOD EMPLOYING AN ACTUABLE TARGET ASSEMBLY

CROSS-REFERENCE TO RELATED APPLICATIONS

This application claims priority from U.S. provisional Patent Application Serial No. 60/205,811, entitled "Firearm Laser Training System and Method Employing an Actuable Target Assembly" and filed May 19, 2000. The disclosure of that provisional application is incorporated herein by reference in its entirety.

BACKGROUND OF THE INVENTION

1. Technical Field

The present invention pertains to firearm training systems, such as those disclosed in U.S. patent application Ser. No. 09/486,342, entitled "Network-Linked Laser Target Firearm Training System" and filed Feb. 25, 2000; Ser. No. 09/761,102, entitled "Firearm Simulation and Gaming System and Method for Operatively Interconnecting a Firearm Peripheral to a Computer System" and filed Jan. 16, 2001; Ser. No. 09/760,610, entitled "Laser Transmitter Assembly Configured For Placement Within a Firing Chamber and Method of Simulating Firearm Operation" and filed Jan. 16, 2001; Ser. No. 09/760,611, entitled "Firearm Laser Training System and Method Employing Modified Blank Cartridges for Simulating Operation of a Firearm" and filed Jan. 16, 2001; and Ser. No. 09/761,170, entitled "Firearm Laser Training System and Kit Including a Target Having Sections of Varying Reflectivity for Visually Indicating Simulated Projectile Impact Locations" and filed Jan. 16, 2001. The disclosures of the above-mentioned patent applications are incorporated herein by reference in their entireties. In particular, the present invention pertains to a firearm laser training system employing an actuable target assembly to facilitate firearm training, competitions or other firearm related activities.

2. Discussion of the Related Art

Firearms are utilized for a variety of purposes, such as hunting, sporting competition, law enforcement and military operations. The inherent danger associated with firearms necessitates training and practice in order to minimize the risk of injury. However, special facilities are required to facilitate practice of handling and shooting the firearm. These special facilities tend to provide a sufficiently sized area for firearm training and/or confine projectiles propelled from the firearm within a prescribed space, thereby preventing harm to the surrounding environment. Accordingly, firearm trainees are required to travel to the special facilities in order to participate in a training session, while the training sessions themselves may become quite expensive since each session requires new ammunition for practicing handling and shooting of the firearm.

The related art has attempted to overcome the above-mentioned problems by utilizing laser or other light energy with firearms to simulate firearm operation and indicate simulated projectile impact locations on intended targets. For example, U.S. Pat. No. 2,934,634 (Hellberg) discloses an attachment for an ordinary firearm which temporarily converts that firearm to a game or practice device. The conversion is achieved by a special target in combination with attachments for the firearm trigger guard and barrel. The target is actuated by a photocell in response to detection of a light ray. The barrel includes an illumination source attached thereto, while the trigger guard has a time delay switch enabling the light source to remain illuminated for a period of time sufficient to assure actuation of the target.

U.S. Pat. No. 3,526,972 (Sumpf) discloses a marksman's practicing device for use as an attachment on a shotgun or the like having a casing adapted for attachment to a barrel. The casing includes a light source disposed therein having a trigger-actuated switch to energize the light source to produce a light beam within the casing and a beam directing mechanism for projecting the beam coaxially from the barrel. The device is employed in connection with a light sensitive target having a bull's eye formed by a selenium cell or the like. The cell may be installed in a stationary position or constructed for movement in a random or flight imitating path, and is connected to an audio visual signal device to indicate a hit upon the target.

U.S. Pat. No. 3,633,285 (Sesney) discloses a laser transmitting device for marksmanship training. The device is readily mountable to the barrel of a firearm and transmits a light beam upon actuation of the firearm firing mechanism. The laser device is triggered in response to an acoustical transducer detecting sound energy developed by the firing mechanism. The light beam is detected by a target having a plurality of light detectors, whereby an indication of aim accuracy may be obtained.

U.S. Pat. No. 3,995,376 (Kimble et al) discloses a miniaturized laser assembly mounted on a weapon where the power source and circuitry for the laser assembly are contained within the weapon. The laser weapon is fired in a normal manner by squeezing the trigger while aiming at a target. The laser emits a harmless invisible signal pulse of coherent light, while a silicon photodiode may be mounted on a stationary, moving, pop-up or personally worn version of the target. In response to activation of the photodiode by a pulse of laser light, circuitry connected to the photodiode energizes a horn to indicate a successfully aimed and fired shot.

U.S. Pat. No. 4,048,489 (Gianetti) discloses a light operated target shooting system. An electro-optic light pulse generator is contained in a gun sight holder and serves as the light source in a light responsive target shooting system. The pulse generator is a laser or other light emitting unit, mounted with an optical system, electronic controls and a battery power source in the interior of the unit. When the user shoots the gun, light pulses are beamed in the direction that the gun and sight holder are pointed. In a disclosed system, the light pulses are directed toward a target structure including light sensors spaced over the target surface. The sensors provide electrical signals or a change in an electrically sensed circuit parameter that is used to actuate a scoring device.

U.S. Pat. No. 4,340,370 (Marshall et al) discloses a linear motion and pop-up target training system for training a marksman to fire a simulated weapon. The system includes a model-board having a terrain surface with six pop-up targets and three bi-directional linear motion targets. Each target emits a pulsed beam of infrared light in response to activation by a first microprocessor computer. The weapon includes a sensor that senses the pulsed infrared beam emitted by the activated target. The sensor supplies an analog signal, proportional to the amount of received light, to a rifle electronics circuit that converts the analog signal to a digital logic signal. A second microprocessor computer receives and processes the digital logic signal in accordance with a predetermined computer program to determine whether the marksman has scored a hit, a miss or a near miss upon the activated target.

U.S. Pat. No. 4,662,845 (Gallagher et al) discloses a target system for laser marksmanship training devices. The system includes one or more photodetectors mounted on a target and sensitive to one or more pulses of the wavelength of a laser beam simulating the projectile of a weapon. An amplifier increases the power output of the photodetectors, while the amplified signal operates a frequency selective transducer. The transducer is attached and acoustically coupled to the target and produces a vibration signature simulating the vibration characteristics of a weapon-fired projectile striking the target. A microphone sensitive to the vibration signature of the transducer is acoustically coupled to the target, while a drive mechanism lowers the target out of the field of view of the weapon when the microphone receives a vibration signature from the transducer indicating a hit.

The related art suffers from several disadvantages. In particular, the Hellberg, Sesney and Gianetti systems typically utilize a stationary target to provide firearm training, thereby limiting those systems with respect to the training scenarios and firearm exercises that may be conducted. The Kimble et al and Sumpf systems may employ a moving or actuable target, respectively, however, these targets are employed to simulate a flight path of an actual intended target or to indicate a hit via target actuation. Thus, the targets provide specific aspects of firearm training or are employed merely to indicate a hit, and are similarly limited with respect to the training scenarios and firearm exercises that may be conducted. Further, the Gallagher et al system typically employs a pop-up target utilized for live ammunition, thereby increasing system costs and requiring sufficient space to utilize the targets. The Marshall et al system utilizes a sensor mounted on a firearm, and moving and pop-up targets disposed on a model board that emit light. Accordingly, this system tends to have less accuracy with respect to detecting proper firearm positioning and is limited to the particular scenario presented by the model board. In addition, the systems described above do not generally provide a manner to enable a user to customize and vary the particular training scenario and target sequence or actuation for firearm training.

OBJECTS AND SUMMARY OF THE INVENTION

Accordingly, it is an object of the present invention to simulate operation of a firearm and conduct firearm training exercises with various training scenarios.

It is another object of the present invention to enable a user to customize and vary the particular training scenario and utilize the resulting scenario for firearm training.

Yet another object of the present invention is to employ an actuable target assembly within a firearm laser training system to conduct various firearm training exercises with varying training scenarios.

According to the present invention, a firearm laser training system employing an actuable target assembly includes a laser transmitter assembly, one or more actuable target assemblies each having a target, an interface unit and a computer system. The laser assembly is attached to an unloaded user firearm to adapt the firearm for compatibility with the training system. A user aims an unloaded firearm at a particular target and actuates the firearm trigger to project a laser beam from the laser transmitter assembly toward that target. The target assemblies raise and lower targets in accordance with control signals from the computer system.

The interface unit is connected to the target assemblies and to the computer system parallel port and transmits control signals received from the computer system to the target assemblies. In an alternative embodiment, the computer system is connected to a control unit, while the target assemblies are connected to a distribution unit. The control unit is typically connected to the computer system parallel port and transmits control signals received from the computer system to the target assemblies via the distribution unit.

The targets are raised by corresponding target assemblies at prescribed times for a specific time interval to indicate intended targets for the user, and are lowered in response to the beam impacting the raised targets within that interval (e.g., indicating a hit) or upon expiration of the interval without a beam impact (e.g., indicating a miss). The target is used in conjunction with signal processing circuitry adapted to detect the laser beam. A corresponding target assembly control unit analyzes detection signals from an associated target to lower that raised target in response to beam impact and forwards information to the computer system to provide feedback information to the user via a display.

The above and still further objects, features and advantages of the present invention will become apparent upon consideration of the following detailed description of specific embodiments thereof, particularly when taken in conjunction with the accompanying drawings wherein like reference numerals in the various figures are utilized to designate like components.

BRIEF DESCRIPTION OF THE DRAWINGS

FIG. 13 is an exemplary report generated by the system of FIG. 1.

DETAILED DESCRIPTION OF THE PREFERRED EMBODIMENTS

Figure 1:
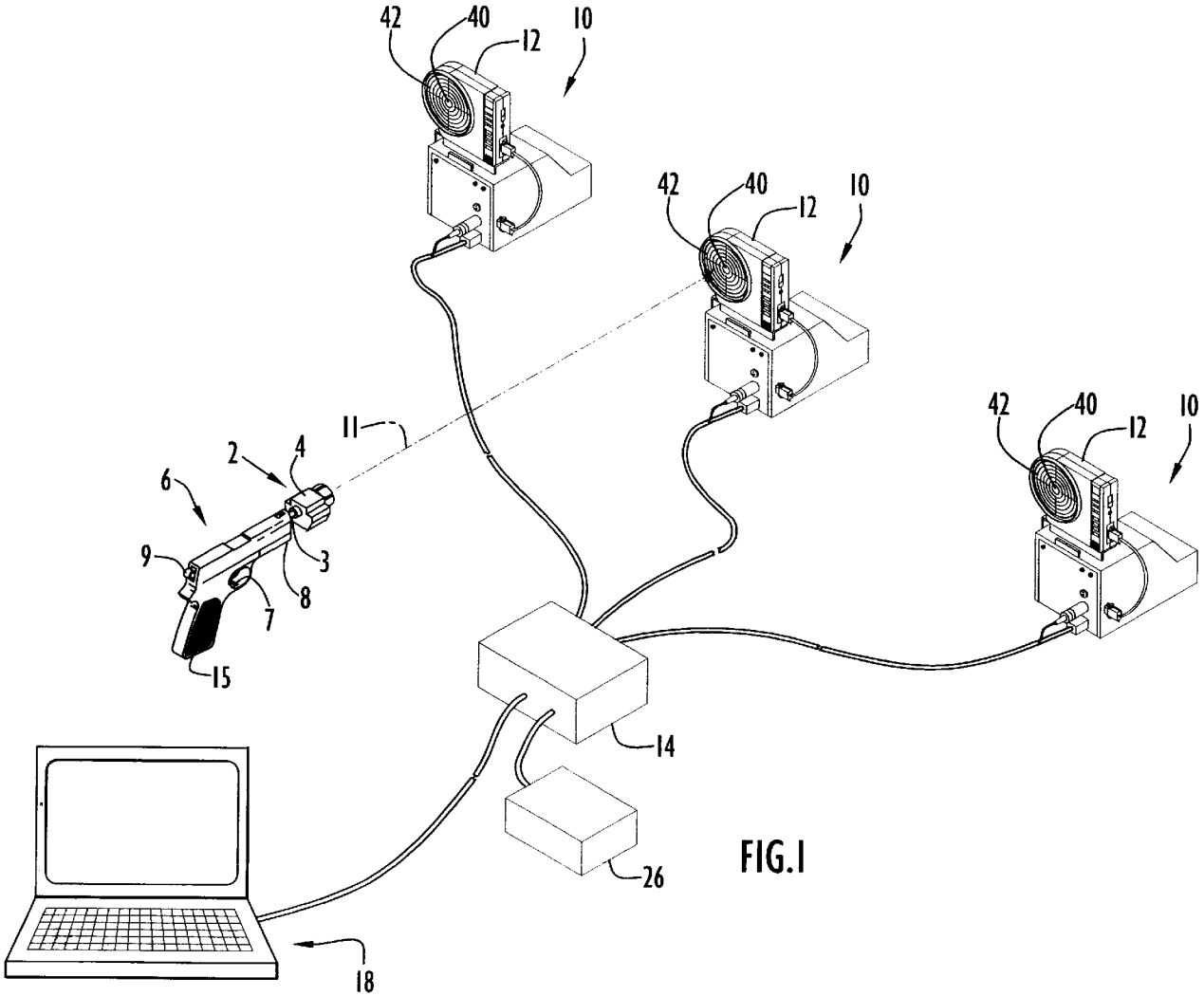
FIG. 1 is a view in perspective of a firearm laser training system having a laser beam directed from a firearm onto an actuable target assembly according to the present invention.

A firearm laser training system employing an actuable target assembly according to the present invention is illustrated in FIG. 1. Specifically, the firearm laser training system includes a laser transmitter assembly 2, actuable target assemblies 10 each having a target 12, an interface unit 14 and corresponding power supply 26 and a computer system 18. The laser assembly is attached to an unloaded user firearm 6 to adapt the firearm for compatibility with the training system. By way of example only, firearm 6 is implemented by a conventional hand-gun and includes a trigger 7, a barrel 8, a hammer 9 and a grip 15. However, the firearm may be implemented by any type of conventional or simulated firearms (e.g., hand-gun, rifle, shotgun, firearms powered by air/carbon dioxide, etc.), while the laser and firearm combination may be implemented by any of the simulated firearms disclosed in the above-mentioned patent applications. Laser assembly 2 includes a laser transmitter rod 3 and a laser transmitter module 4 that emits a beam 11 of visible laser light in response to actuation of trigger 7. Rod 3 is connected to module 4 and is configured for insertion within barrel 8 to fasten the laser assembly to the barrel as described below. A user aims unloaded firearm 6 at a particular target 12 and actuates trigger 7 to project laser beam 11 from laser module 4 toward that target. The target assemblies raise and lower targets 12 in accordance with control signals from computer system 18 as described below. The targets are individually raised by corresponding target assemblies 10 at prescribed times for a specified time interval to indicate intended targets for the user, and are lowered in response to the beam impacting the raised targets within that interval (e.g., indicating a hit) or upon expiration of the interval without a beam impact in response to receiving a signal from the computer system to lower the target (e.g., indicating a miss).

The system may be utilized to simulate live ammunition training systems employed by the military or law enforcement, such as the Remote Electronic Target System (RETS). This type of system is typically employed on a firing range and provides various targets that become raised (e.g., pop-up) for the trainee. The laser training system may simulate the view or conditions the trainee encounters in the RETS system, thereby providing angular perception training and angular queuing training (e.g., training to shoot the highest priority threat or closest target). The laser system typically employs seven targets to simulate the RETS system, but may include any quantity of targets. The targets become raised and/or lowered during the training exercise as described below. In addition, the system may be utilized to simulate firearm competitions, such as the International Practical Shooting Competition (IPSC). The object of this competition is to hit each target in the shortest time interval. The laser system may simulate this competition and measure the time interval for impacting a series of assembly targets.

Figure 3:
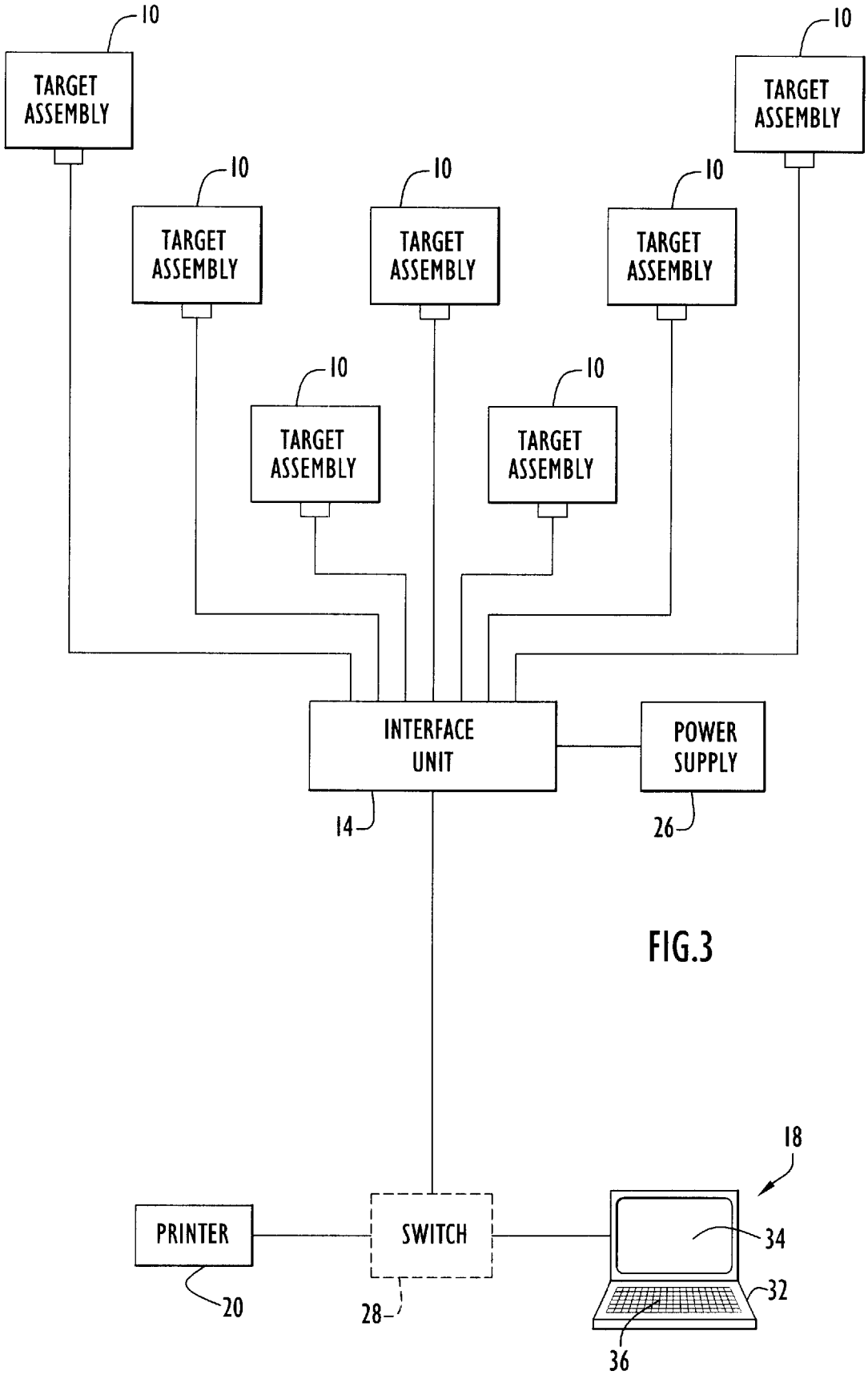
FIG. 3 is a schematic block diagram of the firearm laser training system of FIG. 1.

Target 12 is used in conjunction with signal processing circuitry adapted to detect the laser beam. The target, by way of example, includes a visible circular bull's eye 40 with quadrant dividing lines 42, and detectors disposed across the target surface to detect the beam. A corresponding assembly control unit analyzes detection signals from the detectors to lower the associated raised target in response to beam impact and forwards information to computer system 18 to provide feedback information to the user via a display (FIGS. 11–12 and 14) and/or printer 20 (FIGS. 3 and 13). The target may be scaled to simulate shooting conditions at further distances, such as those within firing ranges, and is similar to the electronic targets disclosed in the above-mentioned patent applications. In addition, the target may utilize masks to display various targets or provide shooting drills (e.g., illustrations of animals with intended target sites, target sites at specific locations or having particular sizes, etc.), such as those disclosed in the aforementioned patent applications. The masks may further be scaled to simulate different distances. The system may utilize real or simulated "dry fire" type firearms or firearms utilizing modified blank cartridges (e.g., such as those disclosed in the above-mentioned patent applications) for projecting a laser beam to provide full realism in a safe environment.

Figure 2:
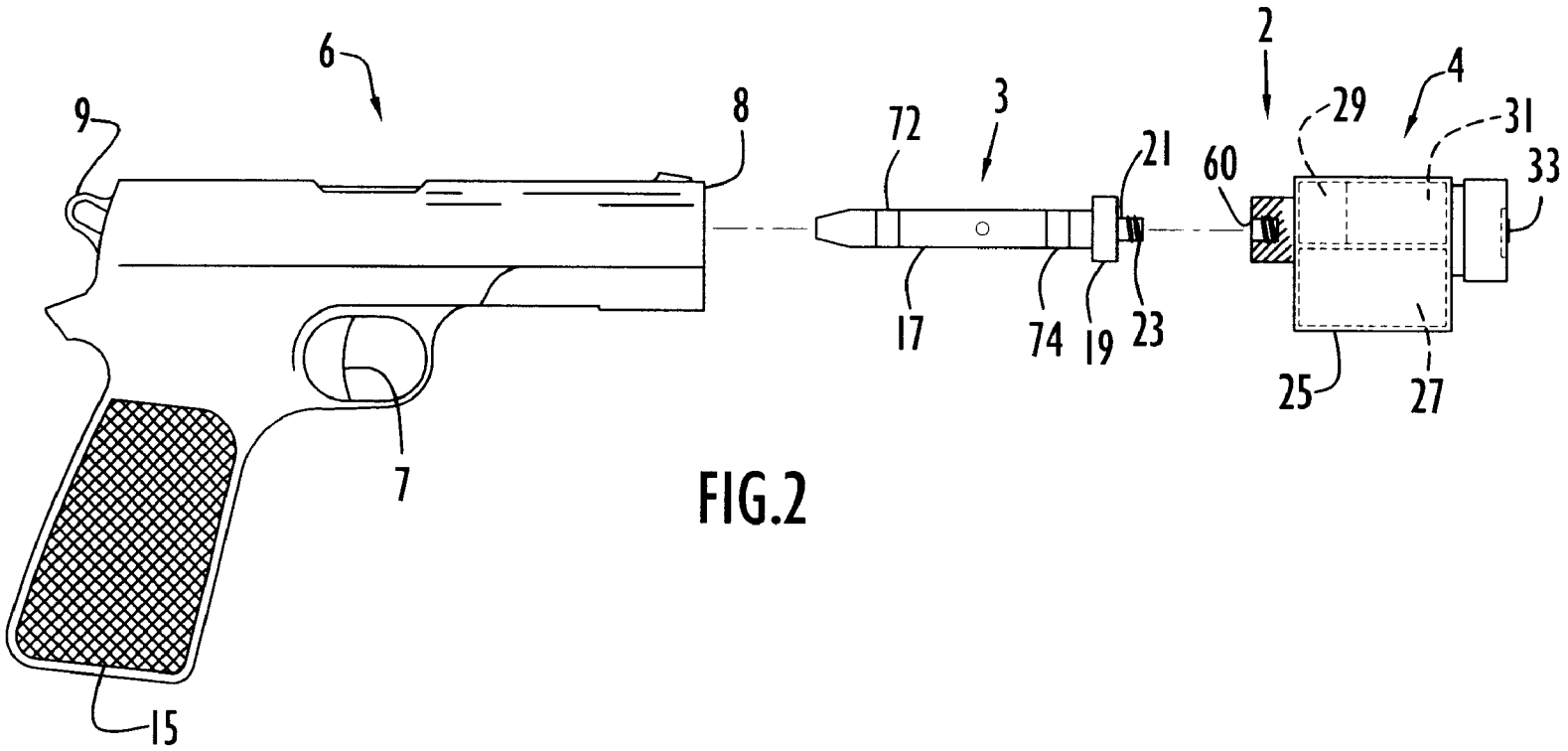
FIG. 2 is an exploded view in perspective and partial section of a laser transmitter assembly of the system of FIG. 1 fastened to a firearm barrel.

An exemplary laser transmitter assembly employed by the training system is illustrated in FIG. 2. Specifically, laser assembly 2 includes laser transmitter rod 3 and laser transmitter module 4. Rod 3 includes a generally cylindrical barrel member 17 and a stop 19 disposed at the barrel member distal end. The barrel member is elongated with a tapered proximal end and has transverse cross-sectional dimensions that are slightly less than the cross-sectional dimensions of barrel 8 to enable the barrel member to be inserted within the barrel. However, the barrel member may be of any shape or size to accommodate firearms of various calibers. Adjustable rings 72, 74 are disposed about the barrel member toward its proximal and distal ends, respectively. The dimensions of each ring are adjustable to enable barrel member 17 to snugly fit within and frictionally engage barrel 8 in a secure manner. Stop 19 is in the form of a substantially circular disk having a diameter slightly greater than the cross-sectional dimensions of barrel 8 to permit insertion of rod sections proximal of the stop into the barrel. The stop may alternatively be of any shape or size capable of limiting insertion of the rod into the barrel. Barrel member 17 is connected to the approximate center of stop 19, while a post 21 is attached to and extends distally for a slight distance from an approximate center of a stop distal surface. Post 21 is substantially cylindrical and has transverse cross-sectional dimensions similar to those of barrel member 17, but may be of any shape or size. The post includes external threads 23 for facilitating engagement with laser module 4 as described below.

Laser module 4 includes a housing 25 having an internally threaded opening 60 defined in an upper portion of a housing rear wall for receiving post 21 and attaching the laser module to rod 3. The housing and opening may be of any shape or size, while the opening may be defined in the housing at any suitable locations. The laser module components are disposed within the housing and include a power source 27, typically in the form of batteries, a mechanical wave sensor 29 and an optics package 31 having a laser (not shown) and a lens 33. These components may be arranged within the housing in any suitable fashion. The optics package emits laser beam 11 through lens 33 toward target 12 or other intended target in response to detection of trigger actuation by mechanical wave sensor 29. Specifically, when trigger 7 is actuated, hammer 9 impacts the firearm and generates a mechanical wave which travels distally along barrel 8 toward rod 3. As used herein, the term "mechanical wave" or "shock wave" refers to an impulse traveling through the firearm barrel. Mechanical wave sensor 29 within the laser module senses the mechanical wave from the hammer impact and generates a trigger signal. The mechanical wave sensor may include a piezoelectric element, an accelerometer or a solid state sensor, such as a strain gauge. Optics package 31 within the laser module generates and projects laser beam 11 from firearm 6 in response to the trigger signal. The optics package laser is generally enabled for a predetermined time interval sufficient for the target to detect the beam. The beam may be coded, modulated or pulsed in any desired fashion. Alternatively, the laser module may include an acoustic sensor to sense actuation of the trigger and enable the optics package. The laser module is similar in function to the laser devices disclosed in the aforementioned patent applications. The laser assembly may be constructed of any suitable materials and may be fastened to firearm 6 at any suitable locations by any conventional or other fastening techniques.

Referring to FIG. 3, computer system 18 controls system operation and may provide various feedback to a user. The computer system is typically implemented by a conventional IBM-compatible laptop or other type of personal computer (e.g., notebook, desk top, mini-tower, Apple Macintosh, palm pilot, etc.) preferably equipped with display or monitor 34, a base 32 (i.e., including the processor, memories, and internal or external communication devices or modems) and a keyboard 36 (e.g., including a mouse or other input device). Computer system 18 includes software to enable the computer system to communicate with and control target assemblies 10 and provide feedback to the user. The computer system may utilize any of the major platforms (e.g., Linux, Macintosh, Unix, OS2, etc.), but preferably includes a Windows environment (e.g., Windows 95, 98, NT, or 2000). Further, the computer system includes components (e.g. processor, disk storage or hard drive, etc.) having sufficient processing and storage capabilities to effectively execute the system software. By way of example only, computer system 18 includes a Pentium or compatible processor and at least sixteen megabytes of RAM.

Computer system 18 and target assemblies 10 are connected to interface unit 14. The interface unit is typically connected to power supply 26 and the computer system parallel port and transmits control signals received from the computer system to target assemblies 10 as described below. The connections between the interface unit, computer system and target assemblies are preferably implemented by suitable cables. However, the connections may be facilitated in any desired fashion (e.g., wireless, etc.). A printer 20 may further be connected to the computer system via a switch box 28 (e.g., a separate unit or integrated within the interface unit) to print reports containing user feedback information (e.g., score, hit/miss information, etc.). The computer system basically transmits report information through the switch box to the printer in response to a setting of a selector switch (not shown) disposed on the switch box. The switch box is manipulable by the user and selectively directs information from the computer system parallel port to either the printer or interface unit. The switch box essentially serves as a power or on/off switch where power is enabled when information is directed to the interface unit. Alternatively, the interface unit and printer may be connected to various other ports of the computer system (e.g., serial, USB, additional parallel part, etc.) and thereby be utilized without the switch box.

The interface unit includes a programmable device or other control circuitry (e.g., microprocessor, logic or other circuitry, etc.) and relays control signals from the computer system to control the target assemblies. Specifically, the computer system generates controls for the target assemblies in accordance with an entered target sequence. The control information typically includes a command to raise or lower a specific target. The computer system may control each target assembly individually. The control signals are encoded by the computer system and transmitted to the interface unit through the computer system parallel port. The interface unit receives the encoded signals and decodes them to determine the controls for the individual target assemblies. The interface unit checks the current status of the target assemblies (e.g., may request information from an assembly), and in response to proper status, transmits the control signals to the control units of the appropriate target assemblies. Thus, the interface unit basically decodes control signals and disseminates them through the various bits of a transmitted signal. The interface unit may alternatively communicate with the computer system via wireless communication devices.

Figure 4:
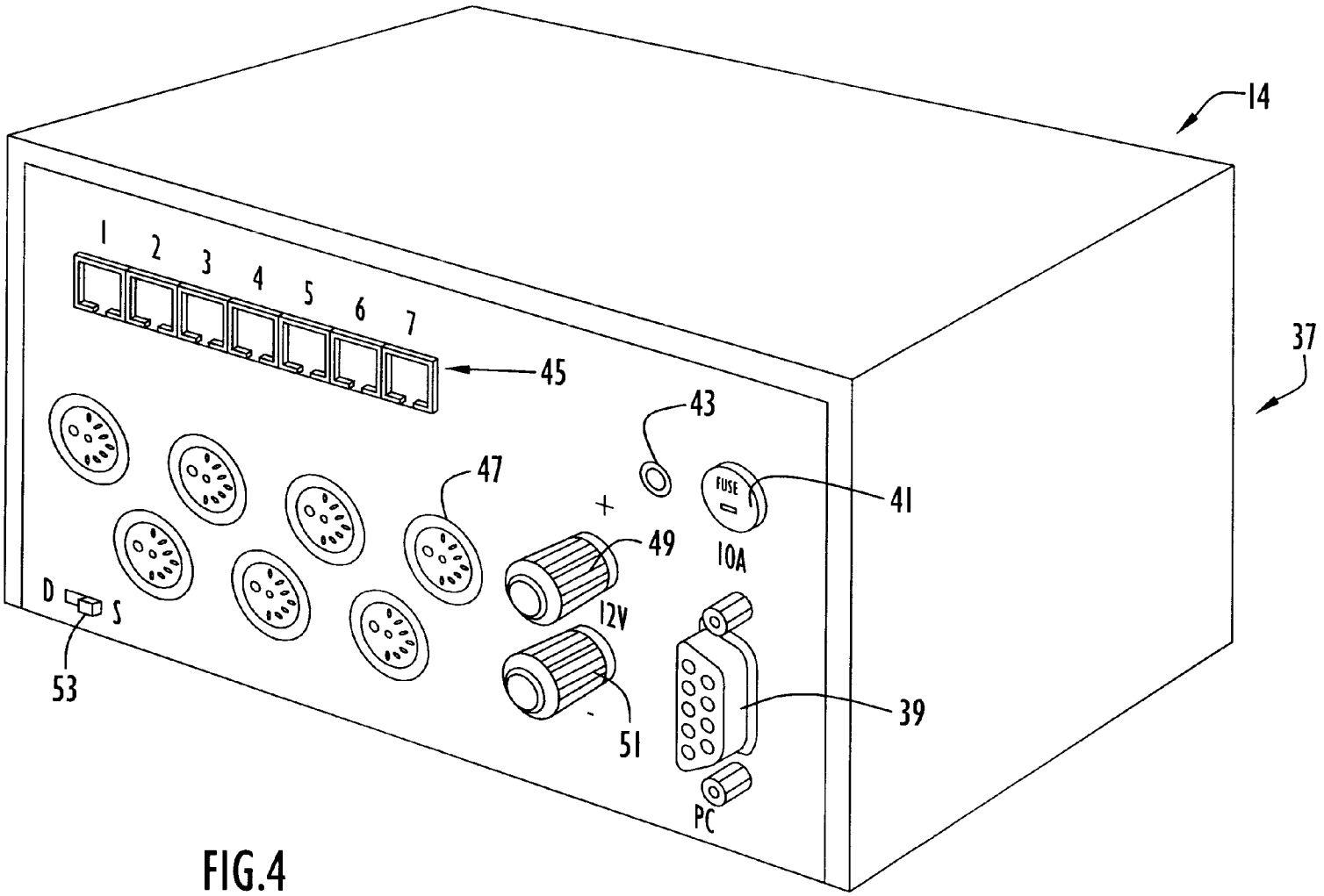
FIG. 4 is a view in perspective of an interface unit of the system of FIG. 1.

Referring to FIG. 4, the interface unit includes a housing 37 having the programmable device or control circuitry disposed therein and a front panel. The front panel includes a computer interface connector 39, a fuse 41, a light emitting diode (LED) 43, data receptacles or sockets 45, motor receptacles or sockets 47, switch 53 and positive and negative power terminals 49, 51. Connector 39 facilitates connection of the interface unit to a parallel or other port of computer system 18 (FIG. 3), while fuse 41, typically a conventional ten amp fuse, protects the internally housed programmable device and/or circuitry. LED 43 is typically illuminated to indicate reception of power signals by the interface unit. Data receptacles 45 receive cables that are connected to the target assemblies and facilitate transmission of power signals and transference of information over the cables between the target assemblies and interface unit. Each data receptacle corresponds to or is associated with a target assembly and, via the cable, provides power signals for target assembly electronics to that target assembly. Further, each data receptacle facilitates transmission and reception of information over the cable between that target assembly and the interface unit. By way of example only, the interface unit includes seven data receptacles. Motor receptacles 47 receive cables that are connected to the target assemblies and facilitate transmission of power signals over the cables between the target assemblies and interface unit. Each motor receptacle corresponds to or is associated with a target assembly and, via the cable, provides power signals for a target assembly motor to manipulate the target. By way of example only, the interface unit includes seven motor receptacles. The cables utilized for connecting the interface unit to the target assemblies may include a combination of the individual cables compatible with the data and motor receptacles.

Terminals 49, 51 are connected to the associated terminals of power supply 26 as described below in order to receive power from the power supply. The terminals typically receive power signals in the form of 12V DC. These signals may alternatively be supplied from motorized vehicle electrical systems or any other source providing the appropriate power signals (e.g., battery, etc.). The interface unit may further include receptacles or other interfaces for receiving power signals in the form of 13.8V DC or any other desired voltage. Switch 53 is manipulable by a user and designates the quantity of hits or beam impacts detected by the target that are required in order to lower a raised target and transmit information to the computer system as described below. For example, the switch may be manipulable toward an identifier (e.g., "S") to designate that detection of a single beam impact may trigger lowering the raised target and transmission of information, while manipulation of the switch toward another identifier ("D") designates that two hits are required in order to lower the raised target and transmit information.

Figure 5:
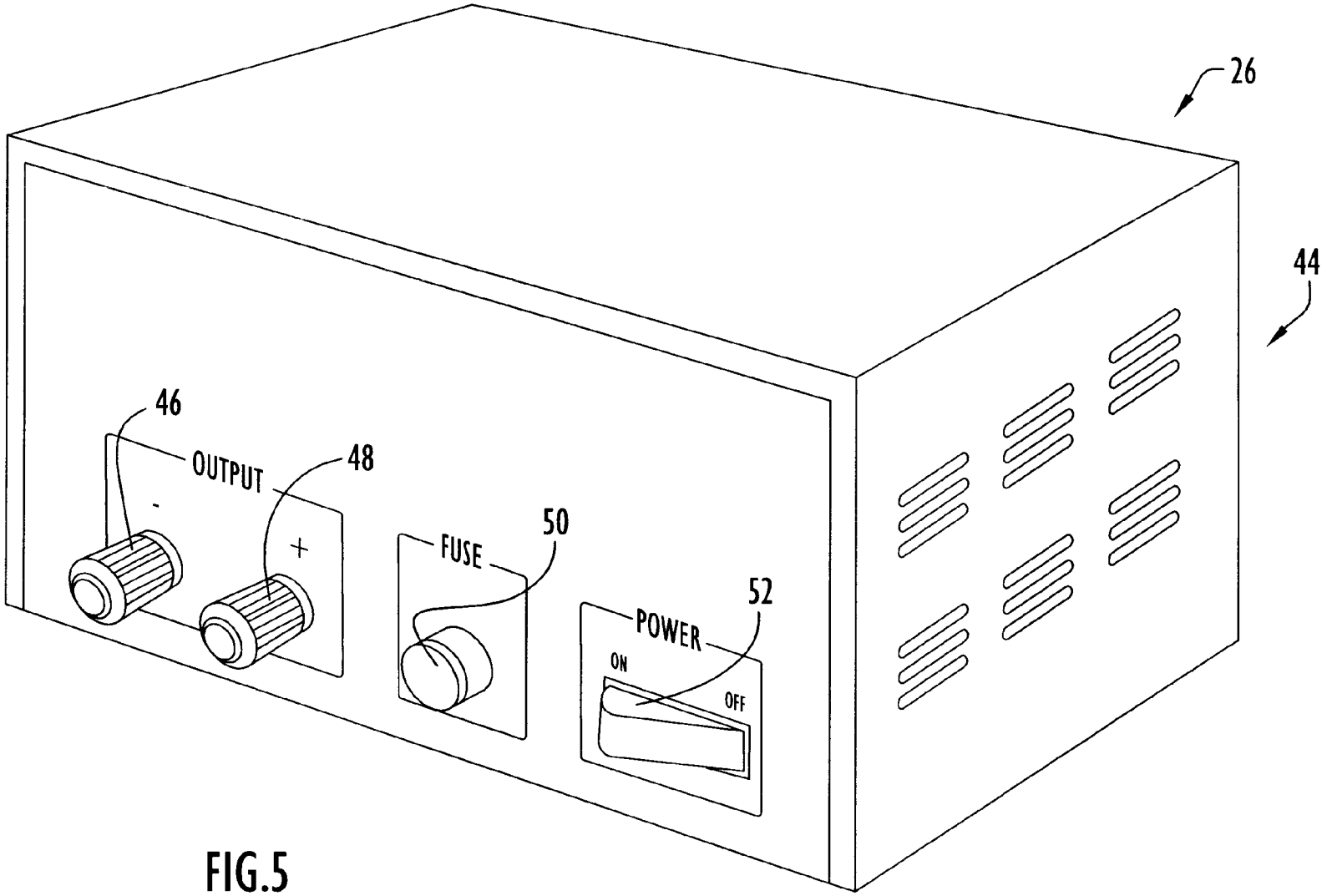
FIG. 5 is a view in perspective of a power supply of the system of FIG. 1.

The interface unit receives power from power supply 26. The power supply typically includes conventional circuitry to provide desired power signals (e.g., 12V DC) and is connected to the interface unit. Referring to FIG. 5, power supply 26 includes a housing 44 having circuitry disposed therein and a front panel. The front panel includes positive and negative terminals 46, 48, a fuse 50 and a power switch 52. The power switch enables power to the power supply, typically in the form of AC signals, while the fuse protects the internally housed circuitry. Terminals 46, 48 are connected to the corresponding interface unit terminals 49, 51 via cables (not shown) to supply the appropriate power signals to that unit as described above.

When a target is raised in response to a control signal, target information associated with that target is transmitted from the corresponding target assembly to the interface unit. This information, by way of example, may be in the form of the target status (e.g., raised or lowered). The interface unit encodes the information and transmits it to the computer system for processing. A target lowered within the prescribed interval indicates a hit, and the computer system processes the information for display and reports as described below. A miss is identified when no hit information is received by the computer system from the specified target assembly prior to expiration of the time interval. In this case, the computer system transmits a control signal to that target assembly to lower the target (unless that assembly is active within the next interval of the sequence) and scores a miss. A hit target is lowered by the target assembly control unit as described below. The hit information may include any type of information to indicate beam impact on a target. The target may be lowered and hit information provided to the computer system in response to detection of a single hit or two hits ("double tap") in accordance with the setting of interface unit switch 53 as described above.

The interface unit typically accommodates a maximum of seven target assemblies, however, the interface unit may be connected to additional interface units in a master/slave arrangement to accommodate an increased quantity of target assemblies. A master unit basically receives control signals from the computer system and transmits the signals to the appropriate slave units accommodating the target assemblies specified in the control signals. The master unit may selectively and individually address the slave units to transmit controls for particular target assemblies. The slave control units are substantially similar to the master unit, but may include fewer components, thereby reducing costs. The master and slave units are generally implemented as separate units. Alternatively, the master units may be selectively configured to operate as either a master or slave unit to enable various configurations for controlling any quantity of targets. The configurable units typically include a switch manipulable by a user to control operation of the unit as a master or a slave. In addition, the interface unit may further include appropriate components or be configured to provide sound effect generation, to accommodate additional target assemblies and/or to operate in an event driven manner.

Figure 6:
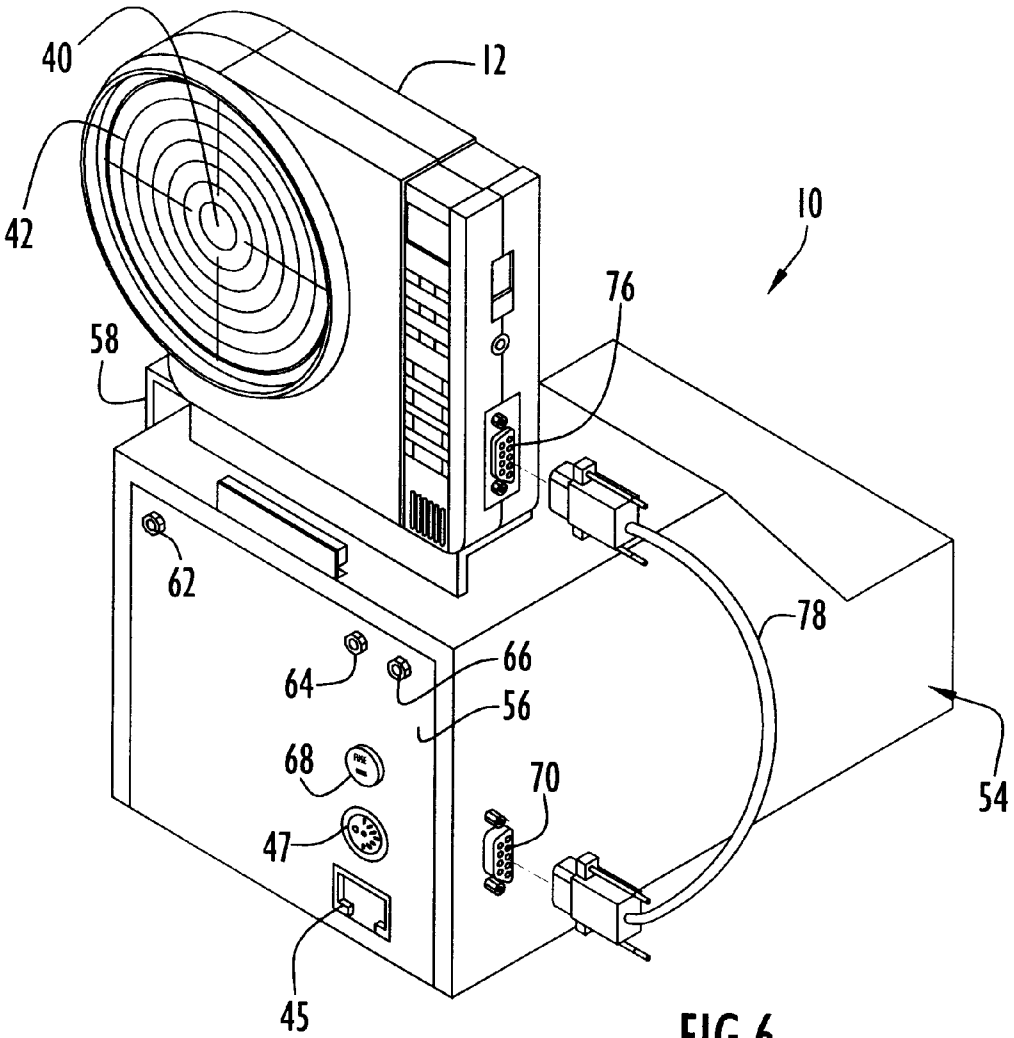
FIG. 6 is a view in perspective of an actuable target assembly of the system of FIG. 1 according to the present invention.

A target assembly 10 according to the present invention is illustrated in FIG. 6. Specifically, the target assembly includes a housing 54 having a front panel 56 and a movable arm 58 with target 12 attached thereto. The housing includes an assembly motor 84 (FIG. 7) and a control unit or control electronics or circuitry 88 as described below. A housing bottom wall includes a threaded hole (not shown) disposed toward each corresponding bottom wall corner. The holes may receive corresponding feet or may be utilized to mount the target assembly on various support structures (e.g., wall, table, door, etc.) or to affix any attachments as desired. Arm 58 is disposed adjacent a housing side wall exterior surface and is attached to a shaft (not shown) that extends through the side wall and is coupled to the assembly motor within the housing. The arm has an inverted 'L' configuration with the target attached to the arm section extending transversely of the housing. The motor rotates the shaft, thereby actuating arm 58 to raise or lower target 12 in response to control signals from assembly control electronics 88 as described below. Travel of arm 58 is controlled by cams (not shown) attached to the shaft which actuate microswitches (not shown) as the arm moves to the end of the desired travel distance. The arm movement is considered complete with the arm either in the up or down position depending upon the direction of actuation. This limiting of arm travel may alternatively be accomplished by any conventional or other techniques, and may further include electronic components, such as diodes, to provide fixed or variable speed control of arm movement.

The housing front panel includes light emitting diodes (LEDs) 62, 64, 66, a fuse 68, motor receptacle 47 and data receptacle 45. LED 62 is typically yellow and flashes in response to raising of target 12, while LED 64 is typically red and is illuminated in response to lowering of the target. LED 66 is typically green and is illuminated in response to lowering of target 12 upon detection of a hit (e.g., the appropriate quantity of hits or beam impacts). Thus, LEDs 64 and 66 are generally illuminated in response to detection of a hit. An additional LED may be disposed on the housing front panel and be illuminated to indicate reception of power signals for the assembly motor. Fuse 68 protects the internally housed control electronics, while motor receptacle 47 is connected to a corresponding interface unit motor receptacle via an appropriate cable and receives power signals for the assembly motor. Data receptacle 45 is connected to the corresponding interface unit data receptacle via an appropriate cable and receives power signals for the control electronics and facilitates transmission and reception of information between the target assembly and interface unit. A housing side wall includes a connector 70 to facilitate connection, via a connector cable 78, to a corresponding connector 76 disposed on target 12 in order to supply power signals to the target and facilitate transmission and reception of information between the target and control electronics as described below.

Figure 7:
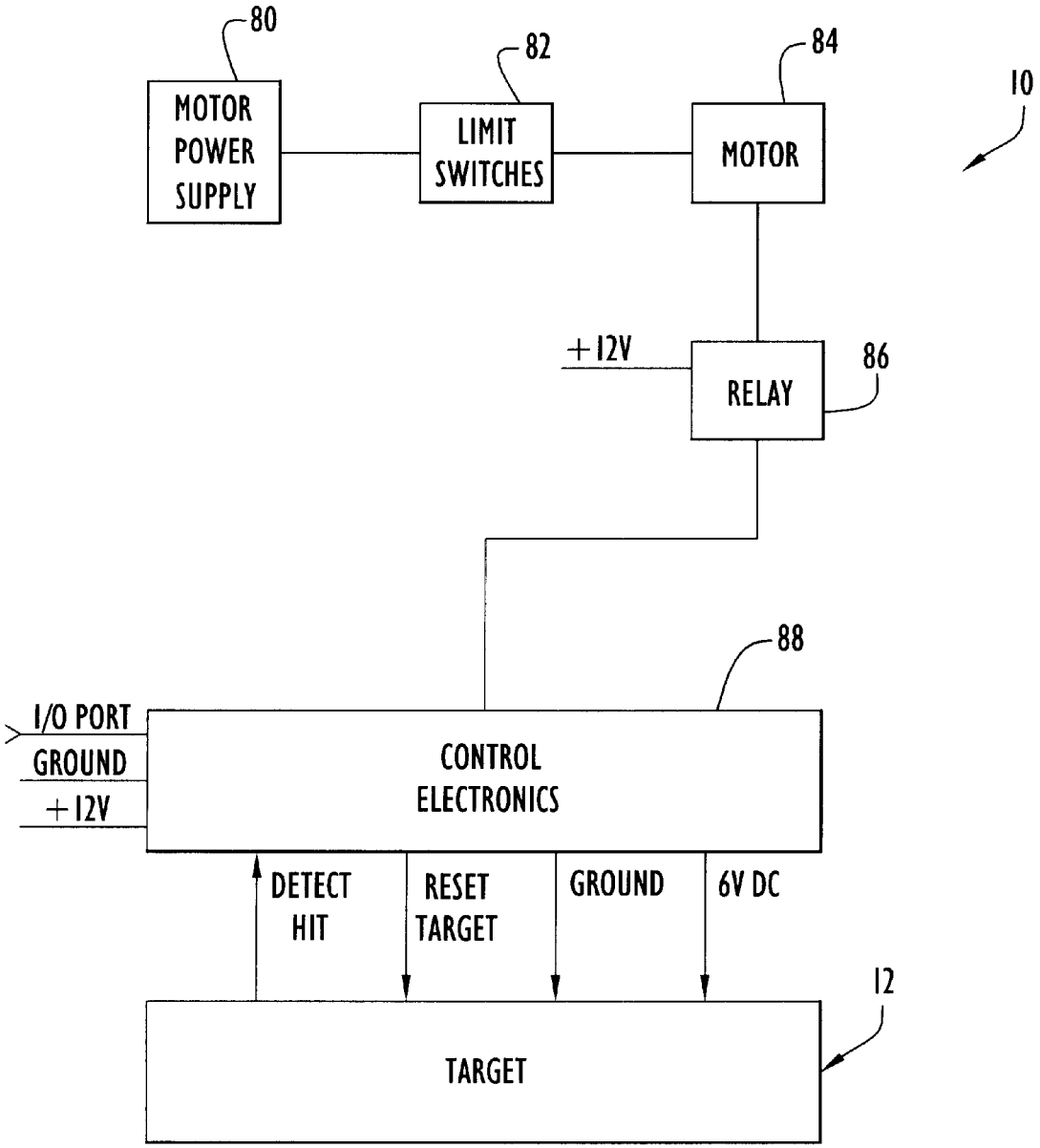
FIG. 7 is a schematic block diagram of the target assembly of FIG. 6.

The target assembly components controlling assembly operation in response to control signals are illustrated in FIG. 7. Specifically, the target assembly includes a motor power supply 80, limit switches 82, motor 84, a relay 86 and control electronics or circuitry 88. The motor actuates arm 58 to raise and lower target 12 and receives power from motor power supply 80, typically in the form of 12V DC. The motor power supply generally receives power from the interface unit via the assembly motor receptacle. Limit switches 82 provide indications of arm position and are utilized to limit movement of the arm within a prescribed angular space. Control electronics 88 may be implemented by logic or other circuitry and activates relay 86 to control motor 84. The relay may be implemented by any conventional relays, and typically receives an input power signal of 12V DC. The control electronics transfers power and information signals through connector 76 to target 12. By way of example only, the control electronics provides reset, ground and power signals (e.g., 6V DC) to the target, and receives from the target a detection signal in response to detection of a hit.

The control electronics receives power (e.g., 12V DC) and ground signals and information from the interface unit via data receptacle 45. The control electronics basically includes an input/output (I/O) port and transfers various signals between the assembly and interface unit. By way of example only, the control electronics may receive control signals conveying instructions in the form of up/down actuation, assembly reset, double/single hit detection (e.g., quantity of hits to lower a raised target and provide information as described above) and utility functions (e.g., sound effects, etc.). The control electronics generally transmits hit detection information to the interface unit via the I/O port. An additional input may be supplied from the control electronics to the interface unit in accordance with a particular application.

The control electronics is coupled to interface unit 14, motor 84 and target 12, and controls target assembly operation in accordance with control signals from computer system 18. The control electronics receives control signals from the interface unit, interprets the control signals and controls the arm to raise the target until the raised target is impacted an appropriate quantity of times by the beam or the computer system directs the control electronics to lower the target due to expiration of the time interval. Further, the control electronics controls target actuation based on the arm position indicated by the limit switch signals as described above. When a time interval for a raised target expires as determined by the computer system, the control electronics receives the appropriate control signals and controls motor 84 to lower the target. In response to the laser beam impacting target 12, the target sends a signal to the control electronics indicating beam impact. The control electronics determines whether or not the appropriate quantity of beam impacts occurred, and if so, controls motor 84 to lower the target. The control electronics unit further transmits a hit indication to interface unit 14 for forwarding to computer system 18. The time intervals and target sequence are programmable via computer system 18 to stimulate various scenarios as described below. The control electronics may further respond to status inquiries of the target assembly by interface unit 14. The target assemblies may further include appropriate components or be configured to provide sound effect generation, visual light indications and/or response to or indication of other events. In addition, the target assemblies may activate any type of devices in response to beam or hit detection in accordance with particular applications (e.g., audio devices, actuators to manipulate objects, visual indicator devices, etc.), and may actuate the targets in response to input signals received from devices detecting events (e.g., audio, motion or other sensors may be utilized to actuate the targets). The additional devices may be modularly configurable or may be in a fixed configuration, or any combination thereof.

Figure 8:
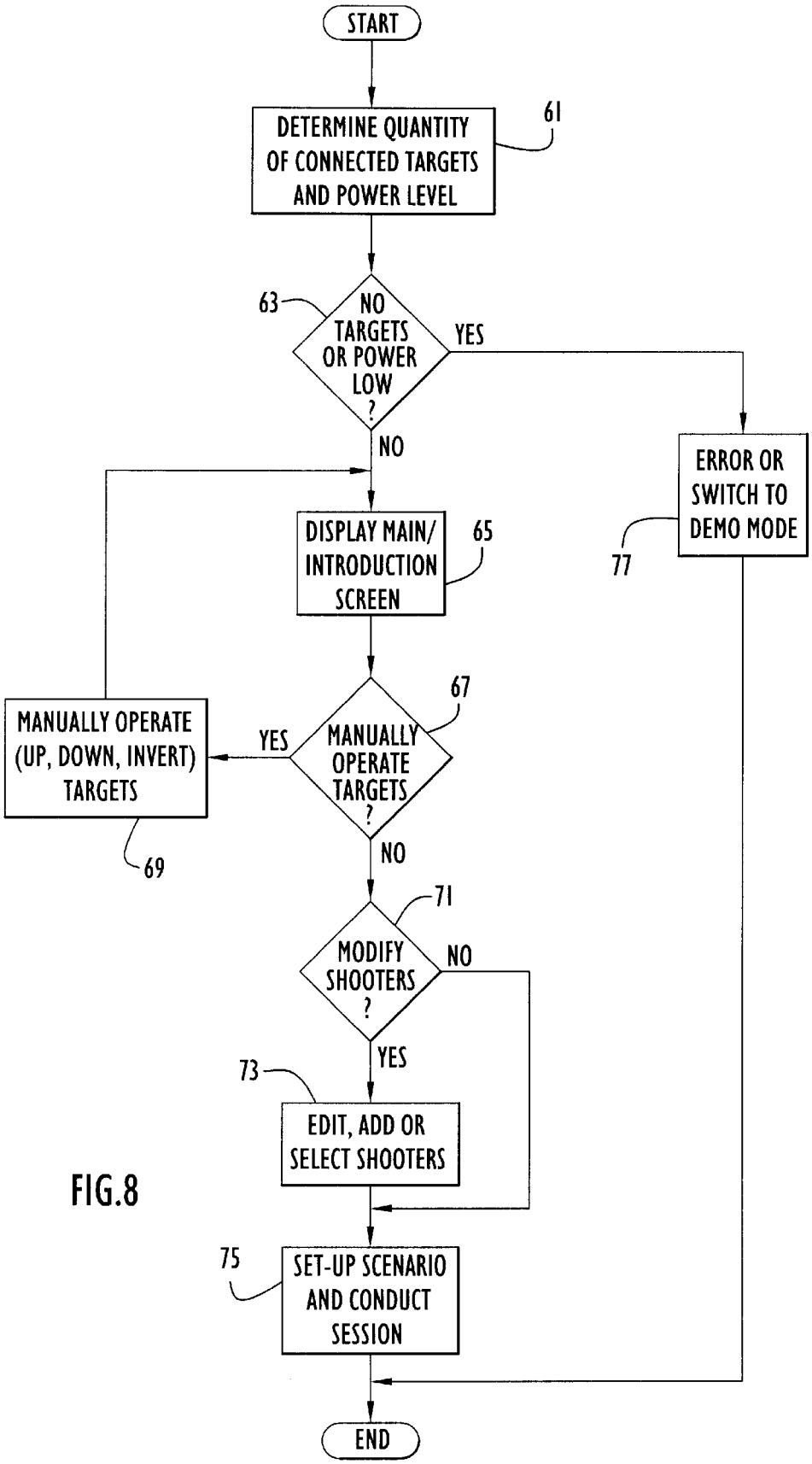
FIGS. 8–9 are procedural flow charts illustrating the manner in which the computer system controls system operation.
Figure 9:
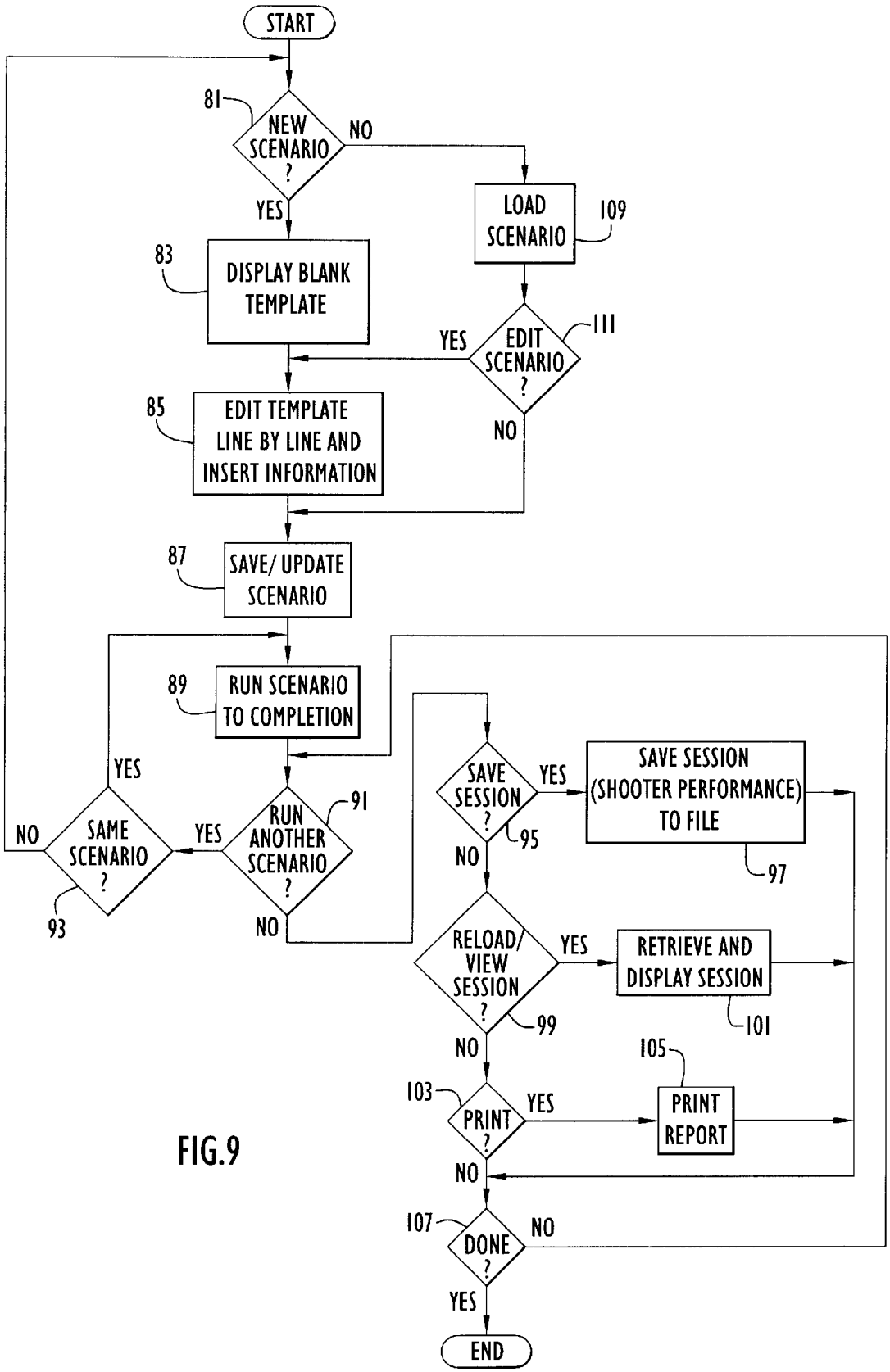

Computer system 18 includes software to control system operation and provide a graphical user interface for displaying user performance and entering information as illustrated in FIGS. 8–9. Initially, the computer system determines the quantity of connected target assemblies and the power level provided to the interface unit at step 61. If no target assemblies are connected or a low power level is detected as determined at step 63, an error is indicated or the system switches to a demonstration mode at step 77. In this mode, system functions are enabled, however, actual transmission and receipt of control signals by the interface unit and associated connections are simulated via software for various purposes (e.g., product demonstration).

Figure 10:
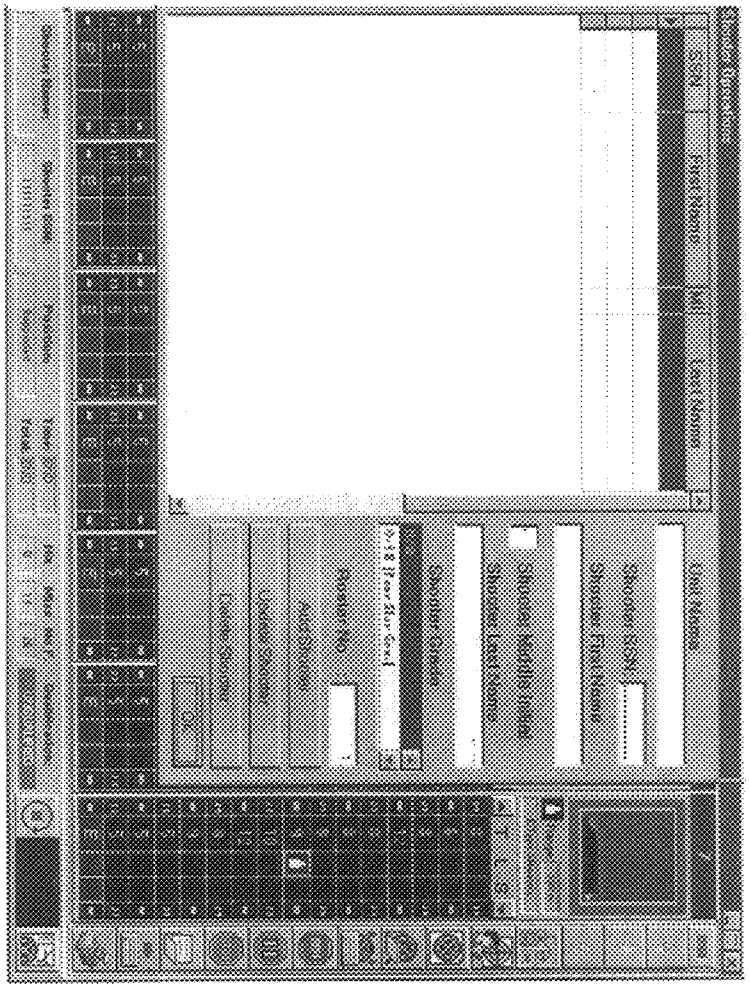
FIGS. 10–12 are schematic illustrations of exemplary graphical user screens displayed by the system of FIG. 1 for training activities.

When the power level is sufficient and at least one target assembly is present, the computer system displays a main or introduction screen at step 65 providing various user options. When a user indicates to the computer system the desire to manually operate the targets as determined at step 67, the user may raise and lower, or invert targets via the computer system at step 69. If the user desires to modify the participants of an activity as determined at step 71, the user may edit existing shooters or participants, enter additional participants or select a participant at step 73 (e.g., via the screen of FIG. 10). Once the user has performed the desired preliminary tasks, the particular training scenario is initialized and a session is conducted at step 75.

The procedure to initialize and conduct a session is illustrated in FIG. 9. In particular, when a new scenario is desired by the user as determined at step 81, the computer system displays a blank scenario template at step 83 generally including a start identifier, a blank line and an end identifier. Each template line may be edited by the user at step 85 to include desired information. Specifically, a particular target sequence is entered into the computer system to control the target assemblies. The sequence typically includes the order in which targets 12 are to be raised and the duration for maintaining the targets in a raised state to permit beam impact. Each target may be individually controlled and selectively specified in the sequence. In other words, the template may include information relating to the target position (up) and corresponding time interval, shooter position (e.g., stand ("off-hand"), lying down ("prone") or kneeling), the target mask or overlay and range and qualification levels and corresponding scores (e.g., score levels to determine classifications, such as expert, sharp shooter, marksman, not qualified, etc). The time interval for each line or target is accumulated to provide a cumulative time for the scenario. The computer system basically executes instructions on each template line in sequence to provide the scenario.

If a new scenario is not desired as determined at step 81, a scenario or template is retrieved or loaded by the computer system in accordance with a user selection at step 109. When the user desires to edit the loaded scenario as determined at step 111, the scenario may be modified at step 85 in substantially the same manner described above.

Once a scenario is entered or loaded, the scenario is saved and/or updated at step 87 and subsequently executed at step 89. The computer system executes the template by transmitting control signals to the corresponding target assemblies at appropriate times via interface unit 14. The control signals typically include information directing the assemblies to raise associated targets for the time interval specified in the template as described above.

When a specified target is placed in the raised position, this indicates to the user an intended target. The user subsequently aims firearm 6 at the raised target to project laser beam 11 at that target. In response to a beam impact, target 12 provides signals to corresponding control electronics 88 to indicate a hit. Control electronics 88 provides impact signals (e.g., hit information) to the computer system, and lowers the target in response to a hit. When computer system 18 determines expiration of the time interval and has not received a signal from the assembly to indicate a hit, a control signal is transmitted to the corresponding assembly control electronics to lower the target and a miss is recorded. Computer system 18 receives the impact information from the target assemblies and calculates a corresponding score. The score may be based on the time required to hit a target and/or distances between the user and the target or other user defined criteria. Alternatively, the target information may include location information of beam impact (e.g., x and y coordinates) to determine scores based on proximity of the beam impact to an intended target site.

Figure 11:
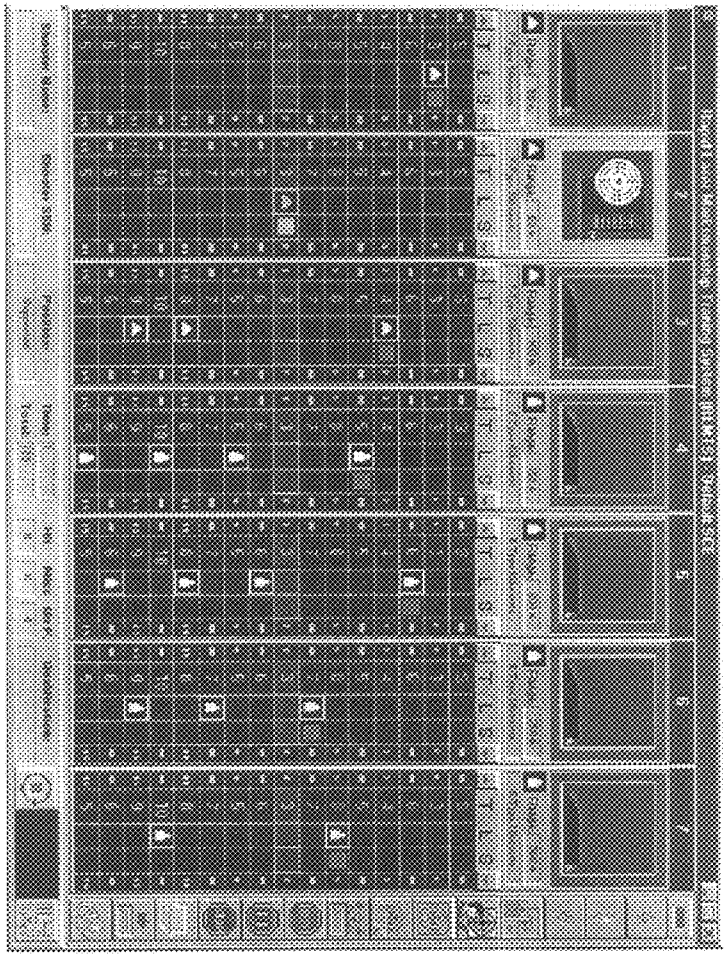
Figure 12:
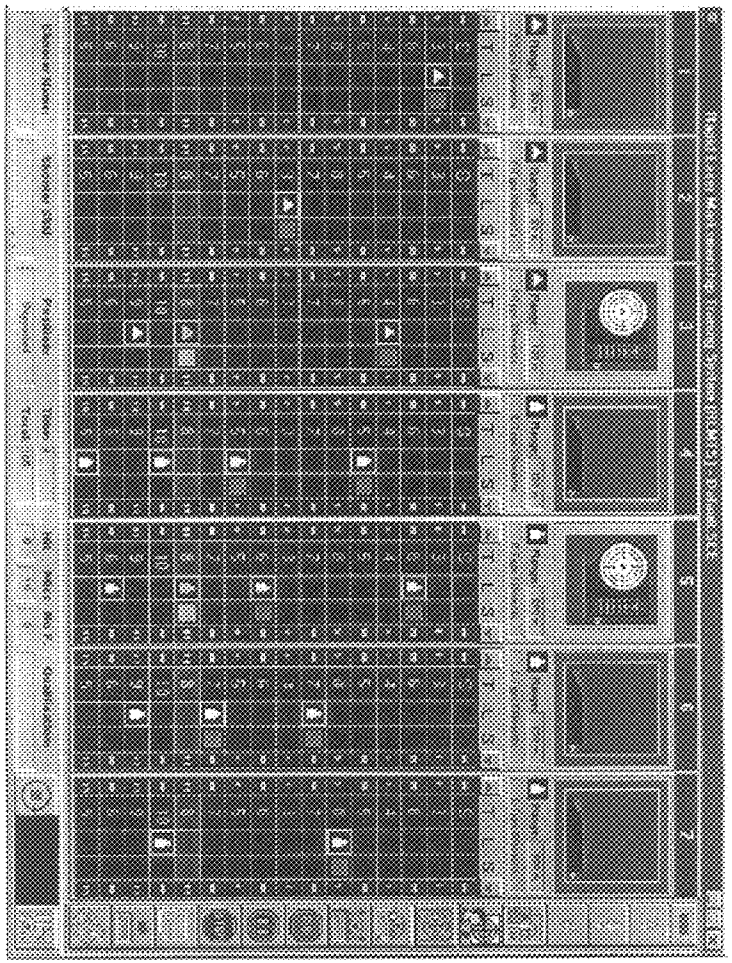

Once scores have been determined, computer system 18 may provide the scores on a graphical user screen as described below. Exemplary screens providing scoring and other information are illustrated in FIGS. 11–12. These screens typically provide the target sequence including the particular target, the time interval of raised status (T), the lane of the target (L), and target status (S). In addition, these screens generally provide a hit or miss indication along with ranges, scoring and other information. A report containing similar information relating to performance of a user may be printed by printer 20 and is illustrated, by way of example only, in FIG. 13. It is to be understood that the screens and report may be arranged in any fashion and include any types of information.

Once a scenario is complete, several options are available to the user. If the user desires to conduct the same scenario as determined at steps 91 and 93, the scenario is repeated at step 89. When a different scenario is desired, a new scenario may be created or loaded in substantially the same manner described above. When a user desires to save a session as determined at step 95, the computer system saves the session or shooter performance in a user specified or predetermined file. If the user desires to reload or view a saved session as determined at step 99, the computer system retrieves a user specified session at step 101 for display on a graphical user screen as described above. When a report is desired by the user as determined at step 103, the computer system prints the report at step 105 as described above. The above process continues until the user indicates completion as determined at step 107.

Figure 14:
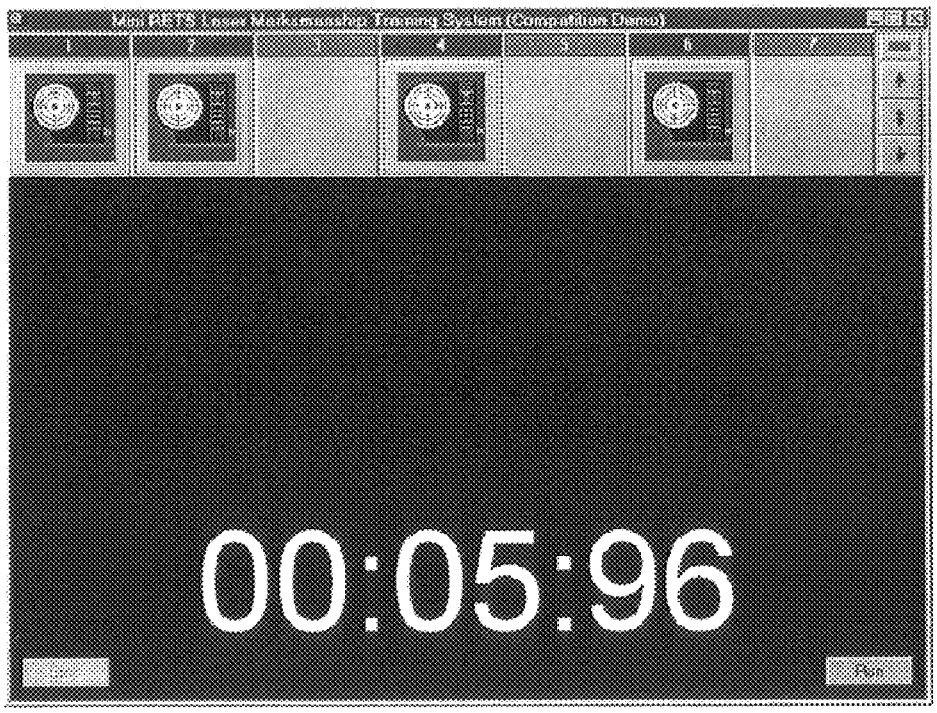
FIG. 14 is a schematic illustration of an exemplary graphical user screen displayed by the system of FIG. 1 for a competition event.

The system may be utilized to simulate a RETS range utilized in military or law enforcement training as described above or to simulate a competition event, such as IPSC. Accordingly, the target may be configured to present any type of graphic to simulate conventional targets for these or other types of activities (e.g., E-type Silhouette, military pop-up targets, plates, etc.). An IPSC event typically utilizes five targets (e.g., plates) that are simultaneously raised. The object is to hit each target in the shortest cumulative time interval. In order to simulate this event, the system may utilize five target assemblies, while computer system 18 may include a sequence or scenario template to control the target assemblies in a manner similar to the competition. The computer system functions as described above to control the target assemblies, and measures the time interval for a user to hit each target or all targets. The results may be displayed or printed by computer system 18 as described above. An exemplary display for an IPSC competition is illustrated in FIG. 14, however, the display may be arranged in any fashion and include any types of information.

Operation of the system is described with reference to FIGS. 1–7. Initially, user information and a target sequence are entered into computer system 18 via graphical user screens (e.g., FIG. 10) as described above. The system may accommodate any sequence for any quantity of target assemblies (e.g., at least one). Laser transmitter rod 3 is connected to laser module 4 and inserted into barrel 8 of firearm 6 as described above. The laser module is actuated in response to depression of firearm trigger 7. Any of the lasers or firearms disclosed in the above-mentioned patent applications may be utilized (e.g., systems employing dry fire or modified blank cartridges). The target assemblies are arranged in a desired configuration and computer system 18 is commanded to control the target assemblies in accordance with the entered sequence or scenario template. As each target 12 is raised, the user aims the firearm and projects a laser beam at that target. When a raised target is impacted an appropriate quantity of times within the specified time interval, the target is lowered and hit information is transmitted to the computer system as described above. In addition, a hit is indicated by the target assembly indicators (LEDs) as described above. If the beam does not impact a raised target within the specified time interval, the target is lowered in response to control signals from the computer system as described above and the computer system scores a miss. The computer system receives the hit information and provides feedback information to the user in the form of graphical user screens (e.g., FIGS. 11–12) and/or a printed report (e.g., FIG. 13) as described above.

Alternatively, the system may simulate a competition, such as IPSC, where the computer system measures the time interval required to hit each of successive targets. The system operates as described above, and further provides the measured time interval on a display (FIG. 14) or printed report.

Figure 15:
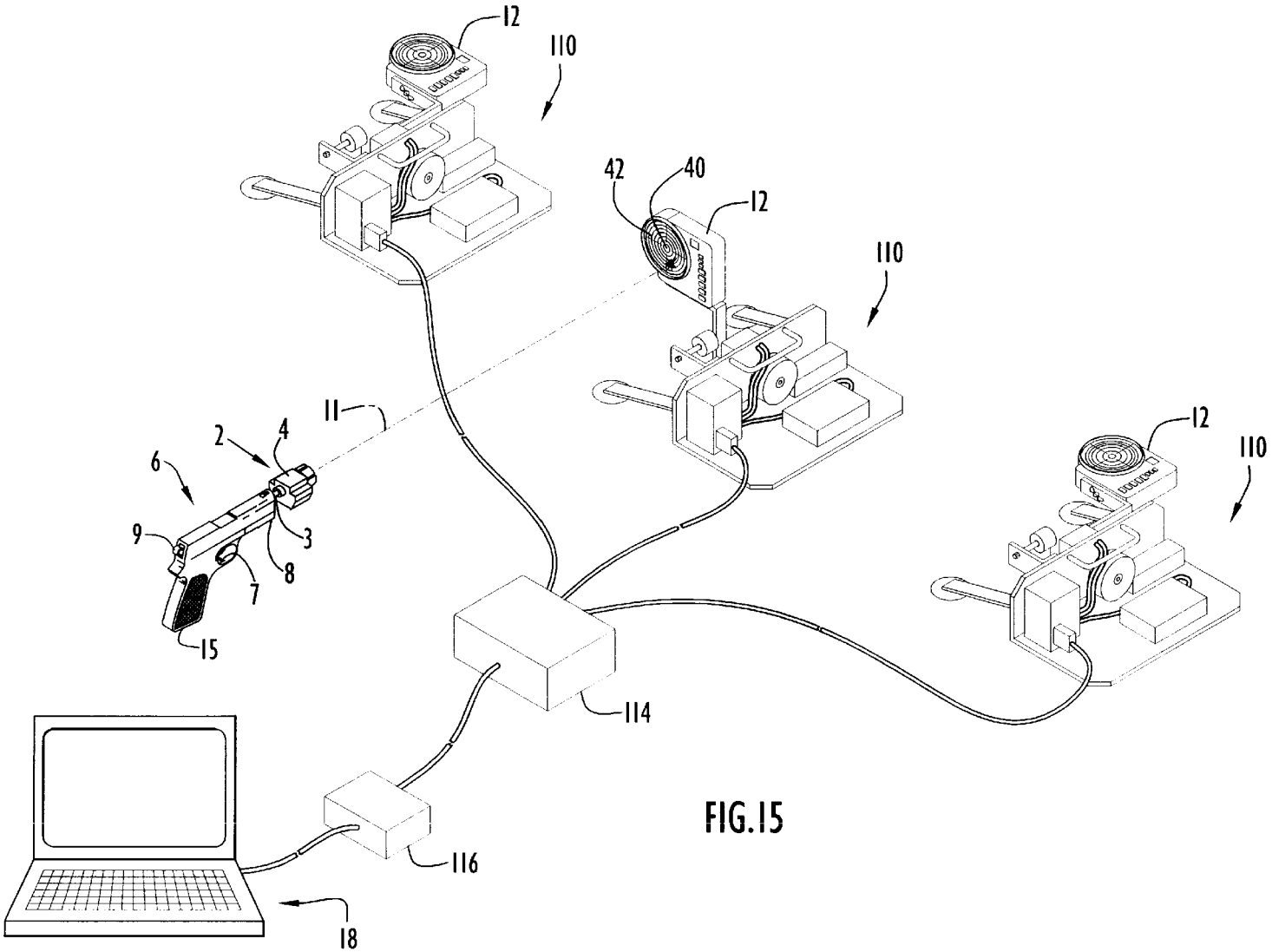
FIG. 15 is a view in perspective of an alternative embodiment of the firearm laser training system of FIG. 1 according to the present invention.

An alternative embodiment of the firearm laser training system employing an actuable target assembly according to the present invention is illustrated in FIG. 15. Specifically, the firearm laser training system includes a laser transmitter assembly 2, actuable target assemblies 110 each having a target 12, a distribution unit 114, a control unit 116 and a computer system 18. The laser assembly is attached to an unloaded user firearm 6 to adapt the firearm for compatibility with the training system. The firearm, laser transmitter assembly, target and computer system are each as described above. A user aims unloaded firearm 6 at a particular target 12 and actuates trigger 7 to project laser beam 11 from laser module 4 toward that target. The target assemblies raise and lower targets 12 in accordance with control signals from computer system 18 as described below. The targets are individually raised by corresponding target assemblies 110 at prescribed times for a specific time interval to indicate intended targets for the user, and are lowered in response to the beam impacting the raised targets within that interval (e.g., indicating a hit) or upon expiration of the interval without a beam impact in response to a signal from the computer system to lower the target (e.g., indicating a miss).

Target 12 is used in conjunction with signal processing circuitry adapted to detect the laser beam and, by way of example, includes a visible circular bull's eye 40 with quadrant dividing lines 42, and detectors disposed across the target surface to detect the beam as described above. A corresponding assembly control unit analyzes detection signals from the detectors to lower the associated raised target in response to beam impact and forwards information to computer system 18 to provide feedback information to the user via a display (FIGS. 11–12 and 14) and/or printer 20 (FIGS. 14 and 16) as described above.

Figure 16:
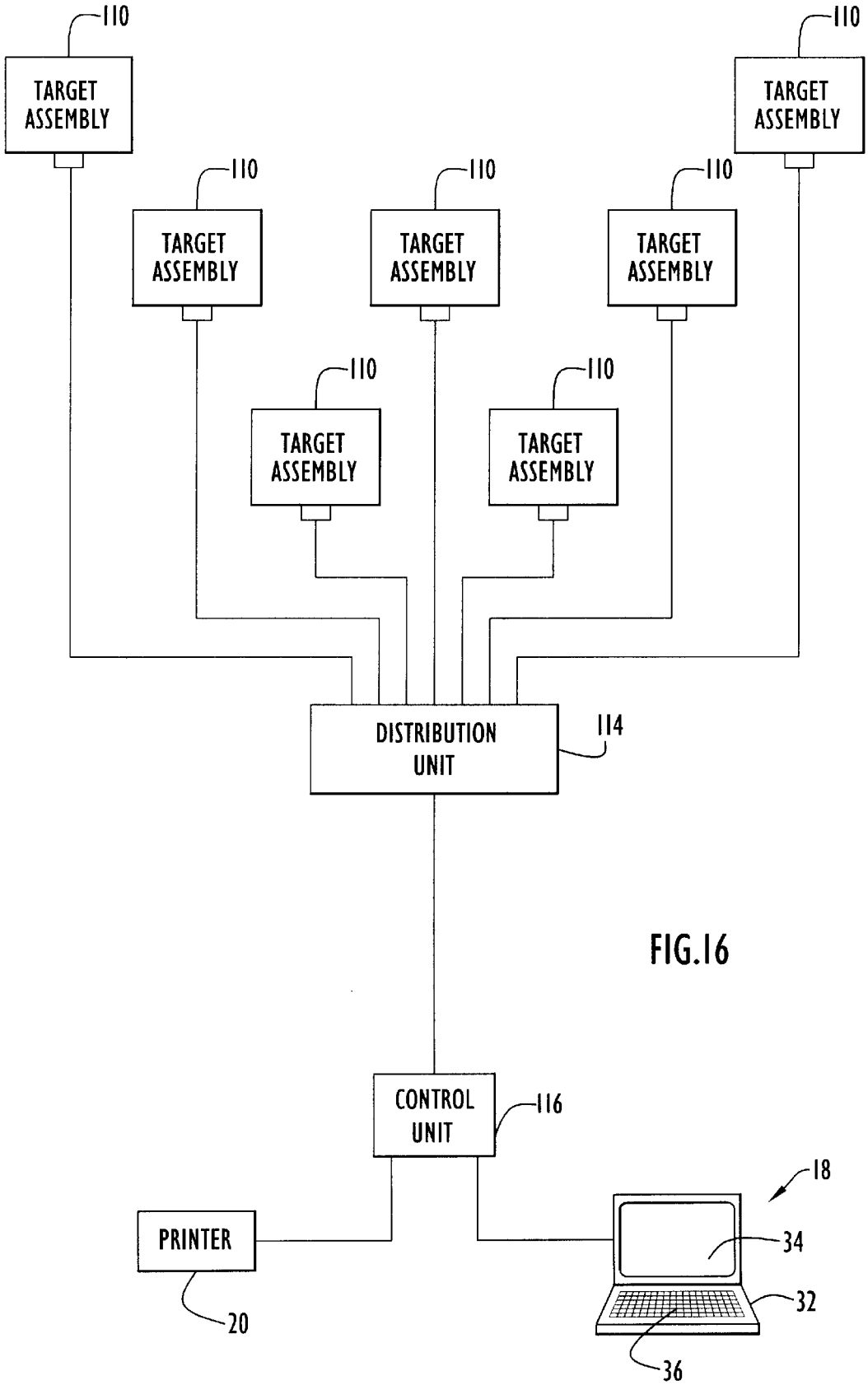
FIG. 16 is a schematic block diagram of the firearm laser training system of FIG. 15.

Referring to FIG. 16, computer system 18 is connected to control unit 116, while target assemblies 110 are connected to distribution unit 114. Control unit 116 is typically connected to the computer system parallel port and transmits control signals received from the computer system to target assemblies 110 via the distribution unit as described below. The connections between the control unit, distribution unit, computer system and target assemblies are preferably implemented by suitable cables. A printer 20 may further be connected to control unit 116 to print reports containing user feedback information (e.g., score, hit/miss information, etc.). The computer system basically transmits the report information through the control unit to the printer via a separate or integrated control unit selector switch (not shown). The switch is manipulable by the user and selectively directs information from the control unit to either the printer or distribution unit. The switch essentially serves as a power or on/off switch where power is enabled when information is directed to the distribution unit.

The control unit includes a conventional or commercially available programmable device (e.g., microprocessor, gate array, etc.) or other control circuitry (e.g., combinational logic, etc.), and relays control signals from the computer system to control the target assemblies. Specifically, the computer system generates controls for the target assemblies in accordance with an entered target sequence. The control information typically includes a command to raise or lower a specific target. The computer system may control each target assembly individually. The control signals are encoded by the computer system and transmitted to the control unit through the computer system parallel port. The control unit receives the encoded signals and decodes them to determine the controls for the individual target assemblies. The control unit checks the current status of the target assemblies (e.g., may request information from an assembly), and in response to proper status, transmits the control signals to distribution unit 114. The distribution unit receives the control signals and forwards them to the control units of the appropriate target assemblies. Thus, the control unit basically decodes control signals and disseminates them through the various bits of a transmitted signal.

When a target is raised in response to the control signal, target information associated with that target is transmitted from the corresponding target assembly to the distribution unit. The distribution unit forwards the information to the control unit. This information, by way of example, may be in the form of the target status (e.g., raised or lowered). The control unit encodes the information and transmits it to the computer system for processing. A target lowered within the prescribed interval indicates a hit, and the computer system processes the information for display and reports as described above. A hit target is lowered by the target assembly control unit as described below. The hit information may include any type of information to indicate beam impact on a target.

The control unit typically accommodates a maximum of seven target assemblies, however, the control unit may be connected to additional control units (e.g., up to three or more units) in a master/slave arrangement to accommodate an increased quantity of target assemblies. The master unit basically receives control signals from the computer system and transmits the signals to the appropriate slave units accommodating the target assemblies specified in the control signals. The slave control units are substantially similar to the master unit, but may include fewer components (e.g., be constructed without the parallel port, printer port or power supply), thereby reducing costs.

Figure 17:
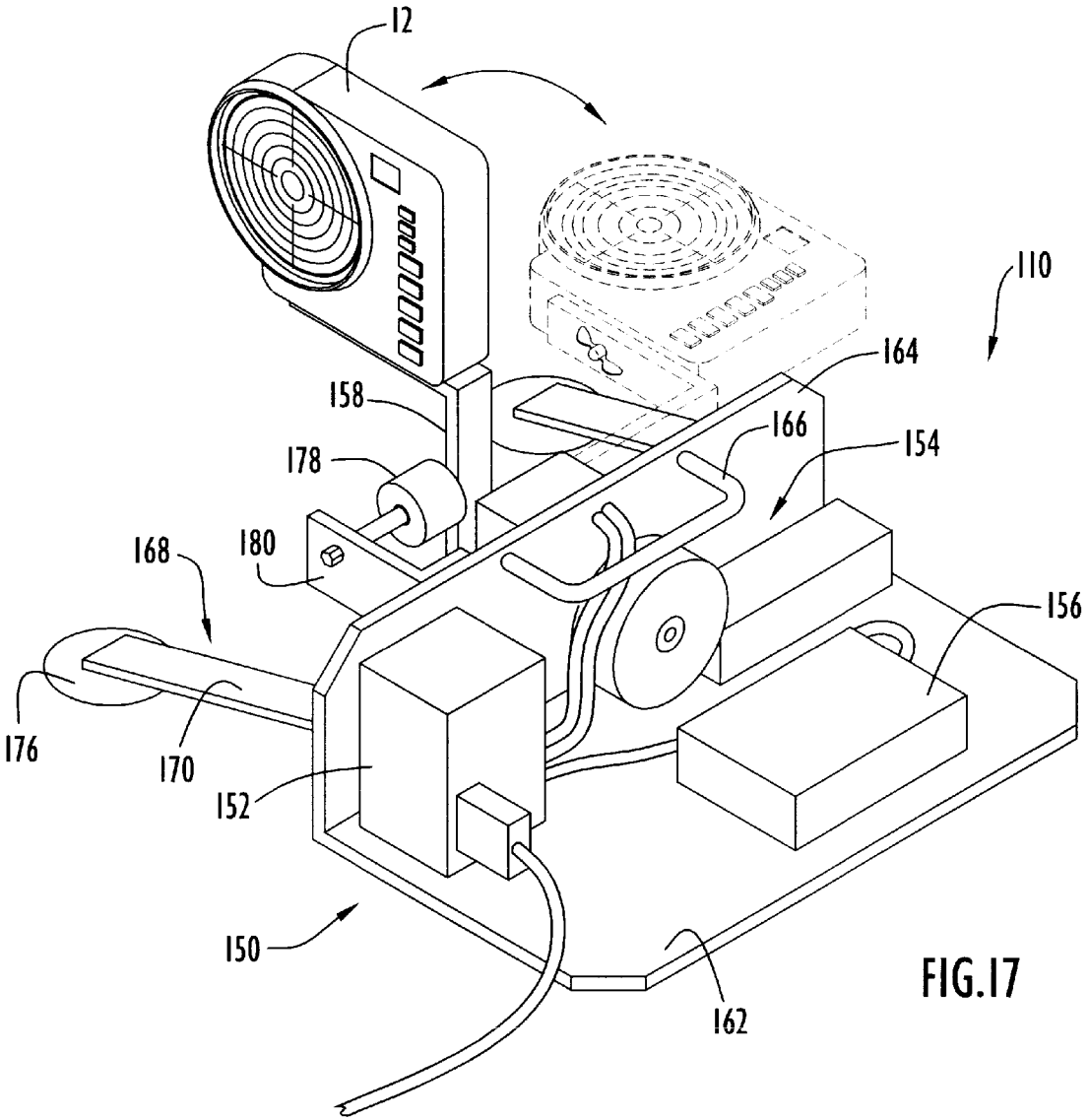
FIG. 17 is a view in perspective of an actuable target assembly of the system of FIG. 15.

A target assembly 110 according to the present invention is illustrated in FIG. 17. Specifically, the target assembly includes a frame 150, an assembly control unit 152, a motor 154, a power source or battery 156 and a movable arm 158 having target 12 attached thereto. Frame 150 includes a base 162 and a side wall 164, each having a generally rectangular configuration. The side wall is substantially perpendicular to the base having its bottom edge joined to a base side edge. A handle 166 is attached to and transversely extends from an upper edge of the side wall interior surface, while legs 168 are attached to and extend from the front and rear lower sections of the side wall to provide stability for the target assembly. The legs each include an elongated bar 170 having a foot 176 disposed at the bar distal end. The base includes assembly control unit 152, motor 154 and power source 156 mounted thereon. Arm 158 is disposed adjacent the side wall exterior surface and is attached to a shaft (not shown) that extends through the side wall and is coupled to motor 154. The arm has an inverted 'L' configuration with the target attached to the arm section extending substantially parallel to the base. The motor rotates the shaft, thereby actuating arm 158 to raise or lower target 12 in response to control signals from assembly control unit 152. A series of switches (not shown) are disposed toward the upper edge of the side wall exterior surface to control arm actuation, while a plurality of stops 178 are disposed in the path of arm movement, via a corresponding bracket 180 mounted to the side wall exterior surface, to limit motion of the arm and target. A pair of cams (not shown) are disposed on the shaft adjacent side wall 164, and are configured to toggle the switches during arm movement. The switches provide signals to assembly control unit 152 to indicate the location of the arm within its motion path, thereby enabling the assembly control unit to control motor 154 accordingly.

Assembly control unit 152 is connected to distribution unit 114, motor 154, power source 156, target 12 and the switches via suitable cables, and controls target assembly operation in accordance with control signals from computer system 18. The assembly control unit includes control circuitry (e.g., processor, logic circuits, etc.) and receives control signals from the distribution unit. The assembly control unit interprets the control signals and controls the arm to raise the target for the specified time interval, or until the raised target is impacted by the beam. Further, the assembly control unit controls target actuation based on the arm position indicated by the switch signals as described above. When a time interval for a raised target expires as determined by the computer system, the assembly control unit controls motor 154 to lower the target in response to control signals from computer system 18. In response to the laser beam impacting target 12, the target sends a signal to the control unit indicating beam impact. The control unit controls motor 154 to lower the target. The assembly control unit further transmits a hit indication to distribution unit 114 for forwarding to computer system 18. The hit information may include the raised or lowered status of the target to enable the computer system to determine the presence of a hit as described above. The time intervals and target sequence are programmable via computer system 18 to stimulate various scenarios as described above. The assembly control unit may further respond to status inquiries of the target assembly by control unit 116.

In addition, assembly control unit 152 includes a series of indicators, preferably in the form of light emitting diodes (LED), to indicate the status of the target. By way of example only, the assembly control unit housing includes three indicators arranged in vertical relation. An uppermost indicator (e.g., red) indicates target 12 in a raised position, while a central indicator (e.g., green) indicates the beam impacting target 12. This indicator remains illuminated until a successive raising and lowering of the target. A lowermost indicator indicates target 12 in a lowered position. A target power switch controls power to assembly control unit 152.

The alternative system functions in substantially the same manner as the system described above, except that control signals and other information are transmitted between the target assemblies and computer system via the control and distribution units. Further, computer system 18 of the alternative system includes software to control system operation and provide a graphical user interface for displaying user performance and entering information in substantially the same manner as the system described above.

The alternative system may similarly be utilized to simulate a RETS range utilized in military or law enforcement training as described above or to simulate a competition event, such as IPSC. Accordingly, the target may be configured to present any type of graphic to simulate conventional targets for these or other types of activities (e.g., E-type Silhouette, military pop-up targets, plates, etc.).

Operation of the alternative system is described with reference to FIGS. 15–17. Initially, user information and a target sequence are entered into computer system 18 via graphical user screens (e.g., FIG. 10) as described above. The system may accommodate any sequence for any quantity of target assemblies (e.g., at least one). Laser transmitter rod 3 is connected to laser module 4 and inserted into barrel 8 of firearm 6 as described above. The laser module is actuated in response to depression of firearm trigger 7. The target assemblies are arranged in a desired configuration and computer system 18 is commanded to control the target assemblies in accordance with the entered sequence. As each target 12 is raised, the user aims the firearm and projects a laser beam at that target. When a raised target is impacted within the specified time interval, the target is lowered and hit information is transmitted to the computer system as described above. In addition, a hit is indicated by the control unit indicator (LED) as described above. If the beam does not impact a raised target within the specified time interval, the target is lowered in response to control signals from the computer system as described above. The computer system receives the hit information and provides feedback information to the user in the form of graphical user screens (e.g., FIGS. 11–12) and/or a printed report (e.g., FIG. 13) as described above.

Alternatively, the system may simulate a competition, such as IPSC, where the computer system measures the time interval required to hit each of successive targets. The system operates as described above, and further provides the measured time interval on a display (FIG. 14) or printed report.

It will be appreciated that the embodiments described above and illustrated in the drawings represent only a few of the many ways of implementing a firearm laser training system and method employing an actuable target assembly.

The systems may include any quantity of target assemblies arranged in any desired fashion. The computer system may be implemented by any conventional or other computer or processing system, and may control the target assemblies to operate in any desired scenario or target sequence. The computer system may be directly or indirectly connected to the target assemblies via any communications mechanisms. Further, the components of the systems may be connected by any communications or other devices (e.g., cables, wireless, network, etc.) in any desired fashion. The computer system may be in communication with other training systems via any type of communications medium (e.g., direct line, telephone line/modem, network, etc.) to facilitate group training or competitions. The systems may be configured to simulate any types of training or competition scenarios. The printer may be implemented by any conventional or other type of printer. The systems may raise any quantity of targets simultaneously to provide multiple targets for a user. The functions of the various components of the systems may be distributed among any quantity of existing or additional components in any desired fashion.

The firearm laser training systems may be utilized with any type of actual or simulated firearm (e.g., hand-gun, rifle, shotgun, machine gun, powered by air/carbon dioxide, etc.), while the laser module may be fastened to the firearm at any suitable locations via any conventional or other fastening techniques (e.g., frictional engagement with the barrel, brackets attaching the device to the firearm, etc.). Further, the systems may include a dummy firearm projecting a laser beam, or replaceable firearm components (e.g., a barrel) having a laser device disposed therein for firearm training. The replaceable components (e.g., barrel) may further enable the laser module to be operative with a firearm utilizing any type of blank cartridges. The laser assembly may include the laser module and rod or any other fastening device. The laser module may emit any type of laser beam within suitable safety tolerances. The laser module housing may be of any shape or size, and may be constructed of any suitable materials. The opening may be defined in the module housing at any suitable locations to receive the rod. Alternatively, the housing and rod may include any conventional or other fastening devices (e.g., integrally formed, threaded attachment, hook and fastener, frictional engagement with the opening, etc.) to attach the module to the rod. The optics package may include any suitable lens for projecting the beam. The laser beam may be enabled for any desired duration sufficient to enable the target to detect the beam. The laser module may be fastened to a firearm or other similar structure (e.g., a dummy, toy or simulated firearm) at any suitable locations (e.g., external or internal of a barrel) and be actuated by a trigger or any other device (e.g., power switch, firing pin, relay, etc.). Moreover, the laser module may be configured in the form of ammunition for insertion into a firearm firing or similar chamber and project a laser beam in response to trigger actuation. Alternatively, the laser module may be configured for direct insertion into the barrel without the need for the rod. The laser module may include any type of sensor or detector (e.g., acoustic sensor, piezoelectric element, accelerometer, solid state sensors, strain gauge, etc.) to detect mechanical or acoustical waves or other conditions signifying trigger actuation. The laser module components may be arranged within the housing in any fashion, while the module power source may be implemented by any type of batteries. Alternatively, the module may include an adapter for receiving power from a common wall outlet jack or other power source. The laser beam may be visible or invisible (e.g., infrared), may be of any color and may be modulated in any fashion (e.g., at any desired frequency or unmodulated) or encoded to provide any desired information.

The laser transmitter rod may be of any shape or size, and may be constructed of any suitable materials. The rod may include dimensions to accommodate any firearm caliber. The rings may be of any shape, size or quantity and may be constructed of any suitable materials. The rings may be disposed at any locations along the rod and may be implemented by any devices having adjustable dimensions. The stop may be of any shape or size, may be disposed at any suitable locations along the rod and may be constructed of any suitable materials. The post may be of any shape or size, may be disposed at any suitable locations on the rod, and may be constructed of any suitable materials. The post or rod may include any conventional or other fastening devices to attach the laser module to the rod.

The target may be implemented by any of the electronic targets described in the aforementioned patent applications, or any device that can detect laser beam impact. The target may be configured and/or include any types of detectors to detect any energy medium having any modulation, pulse or frequency. Similarly, the laser may be implemented by a transmitter emitting any suitable energy wave. The target may be of any shape or size, include any laser detecting circuitry, and present any type of conventional or other target configurations. The target may include any conventional or other fastening devices to attach a mask to the target. The masks may be of any shape or size, may be disposed on the target at any suitable locations and may be constructed of any suitable materials (e.g., may be transparent, translucent, opaque or any combination or degrees thereof). The masks may include any conventional or other fastening devices for attachment to the target. The masks may include any illustration and/or configuration having openings or slots of any shape, size or quantity defined at any suitable locations for training in any types of firearm activities. The masks and targets may be scaled in any fashion to simulate any desired distances.

The interface unit may accommodate any quantity of target assemblies and may include any type of conventional or other processor or circuitry to provide the above-described functions. The housing may be of any shape or size and be constructed of any suitable materials. The interface unit may be connected to any port of the computer system (e.g., parallel, USB, serial, etc.), and may include any quantity of any type of connectors disposed at any suitable locations to connect to the computer system. The interface unit may communicate with the computer system via any suitable medium (e.g., cables, wires, network, wireless, etc.) and transfer any desired information. The control signals and other information may be encoded by or for compatibility with the computer system in any desired fashion. The computer system and other control signals may include any types of information or commands to control the target assemblies in any fashion. The control signals and other information may be formatted in any desired fashion for transmission between the computer system and target assemblies. The switch may be implemented by any conventional switches or circuitry and may designate and enable the system to utilize any quantity of beam impacts to indicate a hit. The switch may utilize any quantity of any type of identifiers to indicate a beam impact quantity. The fuse may be implemented by any conventional or other fuse or protective device. The motor and data receptacles may include any suitable configurations to transmit and/or receive signals. The interface unit may include any quantity of the motor and data receptacles disposed at any suitable locations. The interface unit may include any quantity of any types of terminals or other interfaces to receive power signals from any power source (e.g., power supply, battery, vehicle electrical system, generator, etc.). The cables utilized for communication between the interface unit and target assemblies may be of any quantity, may include any quantity of individual cables in any combination and may be compatible with any suitable receptacles or sockets. The interface unit components may be arranged within the housing in any suitable fashion.

The switch box may be implemented by any conventional or other switching circuitry. The printer and interface unit may be connected to the computer system via different ports, thereby obviating the need to use the switch box. Further, the systems may be utilized without a printer.

The interface unit power supply housing may be of any shape or size and may be constructed of any suitable materials. The power switch may be implemented by any conventional switches or circuitry, while the fuse may be implemented by any conventional or other fuse or protective device. The power supply may include any quantity of any types of terminals or other interfaces to supply power signals of any desired voltage. The power supply components (e.g., switch, terminals, fuse, etc.) may be disposed on the power supply at any desired locations.

The target assembly housing and structural components may be of any shape or size, and may be constructed of any suitable materials. The motor may be implemented by any suitable motor or driver, while the motor power supply may be implemented by any conventional or other power supply to provide appropriate power signals to the motor. The relay may be implemented by any type of conventional or other relay and utilize any input voltage. The limit switches may be implemented by any conventional switches or circuitry, while the fuse may be implemented by any conventional or other fuse or protective device. The motor and data receptacles may include any suitable configurations to transmit and/or receive signals. The target assembly may include any quantity of the motor and data receptacles disposed at any suitable locations. The target may be attached to the arm via any conventional fastening techniques. The threaded holes may be defined in the assembly at any suitable locations. The assembly components may be implemented by any conventional or other components performing the described functions and may be arranged within the housing in any desired fashion. The arm may be of any shape or size, may be constructed of any suitable materials and may be attached to the shaft or directly to the motor. The arm may be disposed on the target assembly at any desired location and be actuated in any desired direction. The target and target assembly may be connected via any quantity of any type of cable, and may include any quantity of any types of connectors disposed at any suitable locations. The target assembly may transmit and receive any desired information to and from the target and interface unit.

The target assembly may include any quantity of any type of indicators (e.g., LED) of any shape, size or color to indicate target status (e.g., raised, lowered, hit or miss, etc.). The indicators may be illuminated in any fashion (e.g., flash at any desired rate) and be disposed at any suitable locations on the target assembly. The target assembly may be configured to accommodate and actuate any quantity of targets either individually or in any combination. The assembly control electronics may include any conventional or other processor or circuitry to control assembly operation.

It is to be understood that the software for the various processors and/or computer systems may be implemented in any desired computer language and could be developed by one of ordinary skill in the computer arts based on the functional descriptions contained herein and flow charts illustrated in the drawings. The processors and/or computer systems may alternatively be implemented by hardware or other processing circuitry. The display screens and reports may be arranged in any fashion and contain any type of information. The systems may produce any desired type of display or report having any desired information. The computer system may determine scores based on any desired criteria. The various functions of the processors and computer system may be distributed in any manner among any quantity of processing systems or circuitry. The flow charts and/or algorithms described above may be modified in any manner capable of performing the functions described herein. The system may be employed without a computer system where the interface unit or target assemblies raise and lower the targets using time intervals selected by a user via a timing device (e.g., rotary switch, etc.). In addition, control software and/or processors may be integrated in to the interface unit and/or target assemblies to obviate the need for an external computer system.

The templates may include any desired information and control the target assemblies to perform any scenario or sequence. The target assemblies may raise the targets for any desired time interval. The templates may include any desired format and each line may be executed in any desired order.

The alternative target assembly structural components (e.g., frame, base, side wall, legs, arm, etc.) may be of any shape or size, and may be constructed of any suitable materials. The motor may be implemented by any suitable motor or driver. The target may be attached to the arm via any conventional fastening techniques. The legs and stoppers may be attached to the frame via any conventional fastening techniques at any suitable locations. The assembly components may be arranged on the frame in any desired fashion. The handle may be implemented by any conventional or other handle. The cams may be of any quantity, shape or size and may be disposed on the shaft at any suitable locations. The arm may be of any shape or size, may be constructed of any suitable materials and may be attached to the shaft or directly to the motor. The arm may be disposed on the target assembly at any desired location and be actuated in any desired direction. The power source may be implemented by any type of conventional or other power source (e.g., battery, wall outlet jack, etc.). The target may be placed in any desired position by the assembly. The assembly control unit may include any quantity of any type (e.g., LED) of indicators of any shape or size to indicate target status (e.g., raised, lowered, hit or miss, etc.). The target assembly may be configured to accommodate and actuate any quantity of targets either individually or in any combination. The assembly control unit may include any conventional or other processor or circuitry to control assembly operation. The switches may be implemented by any conventional or other switches. Components of the firearm laser training systems may be added or excluded in any fashion to achieve the system functions described above.

The control unit of the alternative system may include any type of conventional or other processor or circuitry to provide the above-described functions. The control signals and other information may be encoded by or for compatibility with the computer system in any desired fashion. The computer system and other control signals may include any types of information or commands to control the target assemblies in any fashion. The control signals and other information may be formatted in any desired fashion for transmission between the computer system and target assemblies. The control unit may be connected to the computer system via any desired port, and may be directly connected to the target assemblies. The distribution unit may include any conventional or other connection devices or circuitry to distribute the control signals to the target assemblies. The distribution unit may be directly connected to the computer system.

It is to be understood that the terms "front", "rear", "side", "up", "down", "top", "bottom", "horizontal", "vertical" and the like are used herein merely to describe points of reference and do not limit the present invention to any particular configuration or orientation. Further, the term "having" and variations thereof recited in the specification and/or claims are used in a non-limiting or non-exclusive sense (e.g., the terms do not exclude other elements).

The present invention is not limited to the applications disclosed herein, but may be utilized for any type of firearm training, gaming or entertainment applications.

From the foregoing description, it will be appreciated that the invention makes available a novel firearm laser training system and method employing an actuable target assembly wherein the system controls target assemblies to raise corresponding targets in a user specified sequence to indicate an intended target to a user and lower the raised target in response to detecting a hit or beam impact or upon expiration of a specified time interval.

Having described preferred embodiments of a new and improved firearm laser training system and method employing an actuable target assembly, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. A firearm laser training system enabling a user to project a laser beam toward one or more targets presented in a particular target sequence in accordance with control signals received from a processing system, said training system comprising:

at least one target actuation means with each target actuation means including a target means for receiving said projected laser beam and including at least one sensing means for detecting said projected laser beam, wherein said each target actuation means is responsive to control signals from said processing system for manipulating said target means into a position indicating presentation to said user; and transference means coupled to said each target actuation means and said processing system for transferring control and operational signals between said processing system and said each target actuation means.

2. The training system of claim 1 further including power means coupled to said transference means for supplying power signals to said transference means.

3. The training system of claim 1 further including processing control means for installation on said processing system for controlling said each target actuation means in accordance with said target presentation sequence and for processing information received by said processing system from said each target actuation means for selective display of user performance during said target presentation in the form of one or more graphical user screens and a printed report.

4. The training system of claim 3 wherein said processing control means includes execution means for facilitating entry of a target presentation sequence by said user into said processing system and for controlling said processing system to actuate said each target actuation means in accordance with said entered target presentation sequence.

5. The training system of claim 1 wherein said each target actuation means further includes:

support means for supporting said target means;

actuating means for actuating said support means to present said target means to said user; and control means coupled to said target means and said processing system for controlling actuation of said support means in response to detection information received from said target means and control signals received from said processing system.

6. The training system of claim 5 wherein said control means controls said actuating means to actuate said support means and raise said target means in response to control signals received from said processing system, and controls said actuating means to actuate said support means to lower said target means in response to detection information received from said target means or in response to control signals received from said processing system upon expiration of a particular time interval for presentation of said target means to said user.

7. The training system of claim 1 wherein said transference means includes:

distribution means coupled to said each target actuation means for transferring control signals and information between said processing system and said each target actuation means; and control means coupled to said processing system for decoding control signals from said processing system and forwarding said decoded signals to said distribution means for distribution to said each target actuation means and for transferring detection information received by said distribution means from said each target actuation means to said processing system.

8. The training system of claim 1 wherein at least one target actuation means is responsive to an input signal from an event detecting device to trigger presentation of said target means in response to detection of a particular event.

9. The training system of claim 1 wherein at least one target actuation means generates an output control signal to actuate an external device in response to detection of a beam impact by said target means.

10. The training system of claim 1 further including impact quantity indicator means manipulable by said user for selectively designating a quantity of beam impacts that are to be detected within a predetermined time interval by said target means of said each target actuation means to comprise a hit.

11. A firearm laser training system enabling a user to project a laser beam toward one or more targets presented in a particular target sequence in accordance with control signals received from a processing system, said training system comprising:

at least one target assembly with each target assembly including a target device including at least one detector to detect said projected laser beam, wherein said each target assembly is responsive to control signals from said processing system to manipulate said target device into a position indicating presentation to said user; and a transference unit coupled to said each target assembly and said processing system to transfer control and operational signals between said processing system and said each target assembly.

12. The training system of claim 11 further including a power supply coupled to said transference unit to supply power signals to said transference unit.

13. The training system of claim 11 further including a printing device coupled to said processing system to generate printed reports including information relating to performance of said user during said target presentation.

14. The training system of claim 13 further including a switching device coupled to said processing system, said transference unit and said printing device to selectively direct signals from said processing system to said transference unit and said printing device.

15. The training system of claim 11 wherein said transference unit supplies power signals to said each target assembly and transfers information between said each target assembly and said processing system to facilitate target presentation and display of user performance during said target presentation.

16. The training system of claim 11 further including a control module for installation on said processing system to control said each target assembly in accordance with said target presentation sequence and to process information received by said processing system from said each target assembly for selective display of user performance during said target presentation in the form of one or more graphical user screens and a printed report.

17. The training system of claim 16 wherein said control module facilitates entry of a target presentation sequence by said user into said processing system and controls said processing system to actuate said each target assembly in accordance with said entered target presentation sequence.

18. The training system of claim 11 wherein said each target assembly further includes:

an arm including said target device attached thereto;

a motor assembly to actuate said arm to present said target device to said user; and a control unit coupled to said target device and said processing system to control actuation of said arm in response to detection information received from said target device and control signals received from said processing system.

19. The training system of claim 18 wherein said motor assembly includes:

a motor to actuate said arm to present said target device to said user;

a motor power supply to supply power signals to said motor;

a plurality of switches disposed along a path of movement of and toggled by said arm to indicate arm position to said control unit during actuation; and a relay to control said motor in response to control signals from said control unit.

20. The training system of claim 18 wherein said control unit controls said motor assembly to actuate said arm and raise said target device in response to control signals received from said processing system, and controls said motor to actuate said arm to lower said target in response to detection information received from said target device or in response to control signals received from said processing system upon expiration of a particular time interval for presentation of said target device to said user.

21. The training system of claim 18 wherein said motor assembly includes:

a motor to actuate said arm to present said target device to said user in response to control signals from said control unit;

a power source to supply power signals to said target assembly; and a plurality of switches disposed along a path of movement of and toggled by said arm to indicate arm position to said control unit during actuation.

22. The training system of claim 11 further including:

a plurality of transference units wherein at least one transference unit is designated as a master unit and remaining transference units are designated as slave units, and wherein each slave unit is associated with at least one said target assembly;

wherein said master unit is coupled to said processing system and each slave unit to transfer power and operational signals between said slave units and said processing system to facilitate communications between said processing system and said each target assembly.

23. The training system of claim 22 wherein each said slave unit is selectively addressable by said master unit.

24. The system of claim 22 wherein at least one transference unit is selectively configurable to operate as either a master unit or a slave unit.

25. The training system of claim 11 wherein said transference unit includes:

a distribution unit coupled to said each target assembly to transfer control signals and information between said processing system and said each target assembly; and a control unit coupled to said processing system to decode control signals from said processing system and forward said decoded signals to said distribution unit for distribution to said each target assembly and to transfer detection information received by said distribution unit from said each target assembly to said processing system.

26. The training system of claim 25 further including a printing device coupled to said processing system to generate printed reports including information relating to performance of said user during said target presentation;

wherein said control unit includes a switching device coupled to said processing system and said printing device to selectively direct signals from said processing system to said printing device.

27. The training system of claim 25 further including:

a plurality of control units wherein at least one control unit is designated as a master unit and remaining control units are designated as slave units, and wherein each slave unit is associated with at least one said target assembly;

wherein said master unit is coupled to said processing system and each slave unit to transfer control signals and information between said slave units and said processing system to facilitate communications between said processing system and said each target assembly.

28. The training system of claim 11 wherein at least one target assembly is responsive to an input signal from an event detecting device to trigger presentation of said target device in response to detection of a particular event.

29. The training system of claim 11 wherein at least one target assembly generates an output control signal to actuate an external device in response to detection of a beam impact by said target device.

30. The training system of claim 11 further including an impact quantity indicator manipulable by said user to selectively designate a quantity of beam impacts that are to be detected within a predetermined time interval by said target device of said each target assembly to comprise a hit.

31. In a firearm laser training system including at least one target assembly with each target assembly including a target device including at least one detector to detect a laser beam and a processing system to control said each target assembly, a method of presenting one or more targets to a user in a particular target sequence to enable the user to project a laser beam at the presented target and thereby conduct a training exercise comprising the steps of:

(a) transferring control and operational signals between said processing system and said each target assembly;

(b) manipulating a corresponding target device into a position indicating presentation to said user, via said each target assembly, in accordance with said control signals received from said processing system; and (c) detecting said projected laser beam, via said manipulated target device, to determine the presence of beam impact on said presented target device.

32. The method of claim 13 further including the step of:

(d) generating printed reports including information relating to performance of said user during said target presentation.

33. The method of claim 31 wherein step (a) further includes:

(a.1) supplying power signals to said each target assembly and transferring information between said each target assembly and said processing system to facilitate target presentation and display of user performance during said target presentation.

34. The method of claim 31 wherein step (b) further includes:

(b.1) controlling said each target assembly in accordance with said target presentation sequence; and said method further includes the step of:

(d) processing information received by said processing system from said each target assembly for selective display of user performance during said target presentation in the form of one or more graphical user screens and a printed report.

35. The method of claim 31 wherein step (a) further includes:

(a) facilitating entry of a target presentation sequence by said user into said processing system; and step (b) further includes:

(b.1) controlling said each target assembly, via said processing system, in accordance with said entered target presentation sequence.

36. The method of claim 31 wherein step (b) further includes:

(b.1) raising said corresponding target device in response to control signals received from said processing system; and (b.2) lowering said corresponding target device in response to detection of beam impact by that target device or in response to control signals received from said processing system upon expiration of a particular time interval for presentation of that target device to said user.

37. The method of claim 31 wherein step (b) further includes:

(b.1) manipulating a corresponding target device into a position indicating presentation to said user, via a corresponding target assembly, in response to an input signal from an event detecting device to trigger presentation of that target device in response to detection of a particular event.

38. The method of claim 31 further including the step of:

(d) generating an output control signal, via said each target assembly, to actuate an external device in response to detection of a beam impact by a corresponding target device.

39. The method of claim 31 wherein step (a) further includes:

(a.1) selectively designating a quantity of beam impacts that are to be detected within a predetermined time interval by said target device of said each target assembly to comprise a hit.

* * * * *